US007871156B2

(12) United States Patent
Usui et al.

(10) Patent No.: US 7,871,156 B2
(45) **Date of Patent: *Jan. 18, 2011**

(54) INK CARTRIDGE FOR INK-JET PRINTING APPARATUS

(75) Inventors: Minoru Usui, Nagano (JP); Satoshi Shinada, Nagano (JP); Takahiro Naka, Nagano (JP); Hisashi Miyazawa, Nagano (JP); Takeo Seino, Nagano (JP); Hisashi Koike, Nagano (JP); Takao Kobayashi, Nagano (JP); Masahiro Kanai, Nagano (JP); Yasuko Hirano, Nagano (JP); Yasushi Akatsuka, Nagano (JP); Takayuki Iijima, Nagano (JP); Noriaki Okazawa, Nagano (JP); Hitoshi Matsumoto, Nagano (JP); Yasuhiro Ogura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 341 days.

This patent is subject to a terminal disclaimer.

(21) Appl. No.: 11/875,546

(22) Filed: Oct. 19, 2007

(65) Prior Publication Data

US 2008/0036834 A1 Feb. 14, 2008

Related U.S. Application Data

(63) Continuation of application No. 09/312,073, filed on May 13, 1999, now Pat. No. 7,300,142.

(30) Foreign Application Priority Data

| | | |
|---|---|---|
| May 13, 1998 | (JP) | 10-130630 |
| May 13, 1998 | (JP) | 10-130631 |
| May 14, 1998 | (JP) | 10-131483 |
| Jun. 9, 1998 | (JP) | 10-175340 |
| Jan. 29, 1999 | (JP) | 11-022036 |
| Jan. 29, 1999 | (JP) | 11-023300 |

(51) Int. Cl.
*B41J 2/175* (2006.01)

(52) U.S. Cl. ..... 347/86

(58) Field of Classification Search ..... None
See application file for complete search history.

(56) References Cited

U.S. PATENT DOCUMENTS 5,359,356 A * 10/1994 Ecklund ..... 347/86

(Continued)

FOREIGN PATENT DOCUMENTS

CN 1125175 A 6/1996

(Continued)

*Primary Examiner*—Matthew Luu
*Assistant Examiner*—Justin Seo
(74) *Attorney, Agent, or Firm*—Stroock & Stroock & Lavan LLP

(57) ABSTRACT

An ink cartridge for an ink jet printer having a housing having at least one wall. The ink cartridge further has at least two ink chambers for containing different ink accommodated in the housing. Ink supply ports are formed in one wall of the housing within each of the ink chambers. Each of the ink supply ports has an inner opening and an outer opening. The distance from the inner opening of a first ink supply port to that of a second ink supply port adjacent to the first ink supply port is different from a second distance from the outer opening of the first ink supply opening to that of the second ink supply port.

2 Claims, 27 Drawing Sheets

U.S. PATENT DOCUMENTS

| | | | | |
|---|---|---|---|---|
| 5,477,963 | A | 12/1995 | Mochizuki et al. | |
| 5,512,926 | A | 4/1996 | Uchikata et al. | |
| 5,552,816 | A | 9/1996 | Oda et al. | |
| 5,576,750 | A | 11/1996 | Brandon et al. | |
| 5,619,237 | A | 4/1997 | Inoue et al. | |
| 5,659,345 | A | 8/1997 | Altendorf | |
| 5,666,146 | A | 9/1997 | Mochizuki et al. | |
| 5,790,158 | A | 8/1998 | Shinada et al. | |
| 5,812,165 | A | 9/1998 | Boyd et al. | |
| 5,905,518 | A | 5/1999 | DeFilippis | |
| 5,971,534 | A | 10/1999 | Sasaki et al. | |
| 6,019,465 | A | 2/2000 | Shinada et al. | |
| 6,022,103 | A | 2/2000 | Yamaguchi | |
| 6,102,533 | A | 8/2000 | Nozawa et al. | |
| 6,106,111 | A | 8/2000 | Taneya et al. | |
| 6,164,769 | A | 12/2000 | Inada et al. | |
| 6,164,772 | A * | 12/2000 | Koitabashi et al. | 347/100 |
| 6,179,415 | B1 | 1/2001 | Okazaki et al. | |
| 6,250,750 | B1 * | 6/2001 | Miyazawa et al. | 347/87 |
| 6,257,710 | B1 | 7/2001 | Haigo | |
| 6,270,207 | B1 * | 8/2001 | Sasaki | 347/86 |
| 6,293,652 | B1 | 9/2001 | Arashima et al. | |
| 6,312,115 | B1 | 11/2001 | Hara et al. | |
| 6,422,691 | B2 | 7/2002 | Kobayashi et al. | |
| 6,793,330 | B2 | 9/2004 | Usui et al. | |

FOREIGN PATENT DOCUMENTS

| | | | |
|---|---|---|---|
| EP | 0 516 088 | | 12/1992 |
| EP | 0 803 365 | A2 | 10/1997 |
| EP | 0 827 334 | A2 | 3/1998 |
| EP | 0 832 747 | | 4/1998 |
| EP | 0 872 355 | | 10/1998 |
| GB | 2 293 141 | A | 3/1996 |
| GB | 2 299 786 | A | 10/1996 |
| GB | 2 314 809 | A | 1/1998 |
| GB | 2 315 045 | A | 1/1998 |
| GB | 2 315 461 | | 2/1998 |
| GB | 2 316 037 | A | 2/1998 |
| GB | 2 316 657 | | 4/1998 |
| JP | 63-004953 | A | 1/1988 |
| JP | 63-037954 | | 2/1988 |
| JP | 63-087242 | A | 4/1988 |
| JP | 63-176635 | | 7/1988 |
| JP | 01-099633 | | 4/1989 |
| JP | 03-150167 | | 6/1991 |
| JP | 04-133746 | | 5/1992 |
| JP | 04-176659 | | 6/1992 |
| JP | 5-162330 | A | 6/1993 |
| JP | 05-345425 | | 12/1993 |
| JP | 06-238909 | A | 8/1994 |
| JP | 7-17049 | A | 1/1995 |
| JP | 07-144416 | A | 6/1995 |
| JP | 07-266575 | A | 10/1995 |
| JP | 07-290717 | | 11/1995 |
| JP | 08-132635 | A | 5/1996 |
| JP | 08-174858 | A | 7/1996 |
| JP | 08-174860 | A | 7/1996 |
| JP | 08-224894 | | 9/1996 |
| JP | 08-267778 | | 10/1996 |
| JP | 8-276601 | A | 10/1996 |
| JP | 08-276605 | | 10/1996 |
| JP | 09-240004 | A | 9/1997 |
| JP | 09-240005 | A | 9/1997 |
| JP | 10-016249 | A | 1/1998 |
| JP | 10-044459 | A | 2/1998 |
| JP | 10-058696 | | 3/1998 |
| JP | 10-76680 | A | 3/1998 |
| JP | 10-109427 | | 4/1998 |
| JP | 10-119257 | | 5/1998 |
| JP | 10-119314 | | 5/1998 |
| JP | 10-235890 | A | 9/1998 |
| JP | 10-286972 | | 10/1998 |
| JP | 10-329331 | | 12/1998 |
| JP | 11-058765 | A | 3/1999 |
| JP | 11-070673 | A | 3/1999 |
| JP | 11-105305 | A | 4/1999 |
| JP | 11-132747 | | 5/1999 |
| JP | 2000-218813 | A | 8/2000 |
| WO | 97-30849 | A | 8/1997 |

* cited by examiner

INK CARTRIDGE FOR INK-JET PRINTING APPARATUS

CROSS-REFERENCE TO RELATED APPLICATION

This application is a continuation of copending application Ser. No. 09/312,073, filed on May 13, 1999.

BACKGROUND OF THE INVENTION

1. Field of the Invention

The present invention relates to an ink cartridge detachably mounted on a carriage, and in particular to a cartridge for an ink jet printer.

2. Related Art

A conventional ink cartridge mounted on a carriage for an ink jet printer typically includes a container having on one wall thereof an ink supply port where an ink supply needle of a printing apparatus is inserted, and an opening on the other wall thereof which is sealed by a lid as disclosed, for example, in Japanese published unexamined patent application No. Hei. 8-132635. The container accommodates therein a porous body impregnated with ink. The porous body is formed of polymeric resin.

For an ink cartridge installed in a printing apparatus wherein color printing is enabled, a single container is divided into plural chambers by one or more partitions. A porous body impregnated with ink is housed in each chamber while an ink supply port is formed in each chamber. A film for sealing a respective opening of each ink supply port is provided when mounting the ink cartridge provided with plural ink supply ports as described above on a carriage on which ink supply needles of the same number are secured, the needles must each pierce a respective film. Therefore, a large urging force is required for a user when mounting the cartridge. Therefore, there has been proposed a printing device designed to have a pivotable lever, one end of which is attached to the carriage, so that the ink cartridge can readily be mounted on the carriage by simply operating the lever.

However, although a cartridge can be mounted with small urging force, misposition of the cartridge with respect to the carriage may occur by rough insertion. Further, as the bottom of the cartridge is pushed with large force in a state in which the bottom comes into engagement with ink supply needles in a case where the cartridge is mounted in a wrong direction, there arises a problem that the ink supply needles are broken.

SUMMARY OF THE INVENTION

Accordingly, it is an object of the invention to provide an improved cartridge for an ink jet printer.

An ink cartridge includes an ink container for accommodating ink therein. An ink supply port is formed on the ink container for receiving an ink supply needle, the ink supply needle communicating with a print head attached to the carriage. One or more recessed parts are formed in the container for receiving a projection protruding from the carriage of the printing apparatus; the recessed part being formed in a position to face the projection. The projection is formed in the vicinity of the ink supply needle in a state in which when the ink cartridge is installed in a regular, proper direction the projection of the carriage inserts into the recessed part of the ink cartridge. The height of the protrusion is designed to be higher than that of the ink supply needle.

When the ink cartridge is properly mounted on the carriage of the printing apparatus, the projection on the carriage first fits into the recessed part of the cartridge, and then the ink supply needle inserts into the ink supply port of the cartridge by further urging the ink cartridge against the carriage. On the other hand, if the ink cartridge is mounted in an improper direction, the projection first comes into abutment against the bottom of the cartridge, and the cartridge cannot be mounted on the carriage.

Another object of the present invention is to provide an ink cartridge capable of fitting onto one or more ink supply needles communicating with a print head only when the cartridge is in a proper position with respect to an ink-jet printing apparatus.

A further object of the present invention is to provide an ink cartridge capable of preventing the ink supply needle of a printing apparatus from being broken due to improper installation of the ink cartridge on the ink-jet printing apparatus.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings (s), in which:

FIG. 5(*b*) is a top plan view showing the sealing plate;

PREFERRED EMBODIMENTS OF THE INVENTION

The detailed description of the preferred embodiments of the present invention will now be described herein below with reference to the accompanying drawings.

Figure 1:
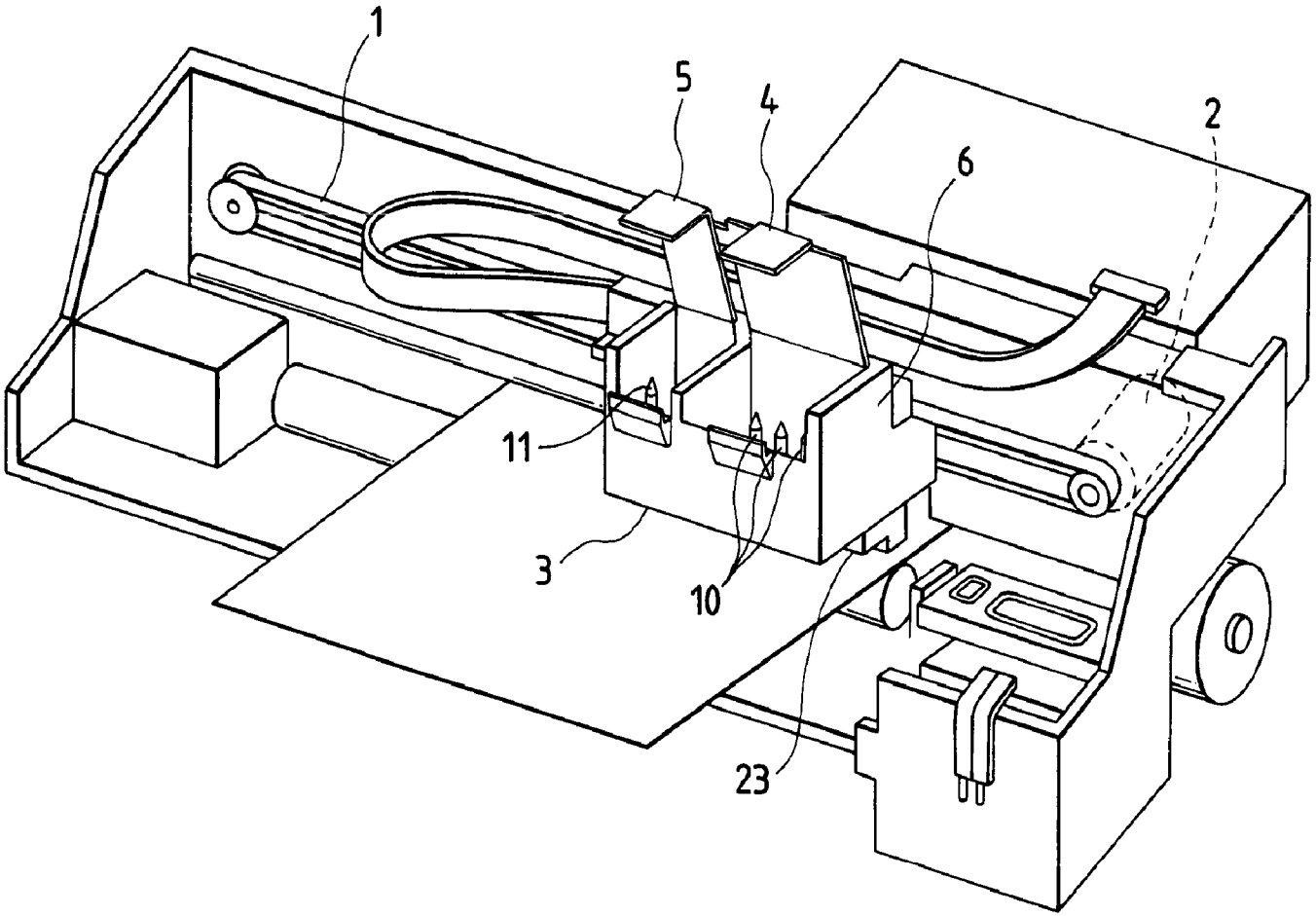
FIG. 1 is a schematic perspective view showing an ink-jet type printing apparatus.

FIG. 1 shows a printing mechanism equivalent to an embodiment of a printing apparatus for executing printing using an ink cartridge according to the present invention. A carriage 3 is reciprocally mounted within a frame 200 and operatively connected to a driving motor 2 via a timing belt 1. A cartridge holder 6, mounted on carriage 3, for mounting thereon both a black ink cartridge and a color ink cartridge respectively is provided with pivotable levers 4 and 5. A print head 23 to which ink is supplied from each ink cartridge is provided on the lower surface of carriage 3.

Figure 2:
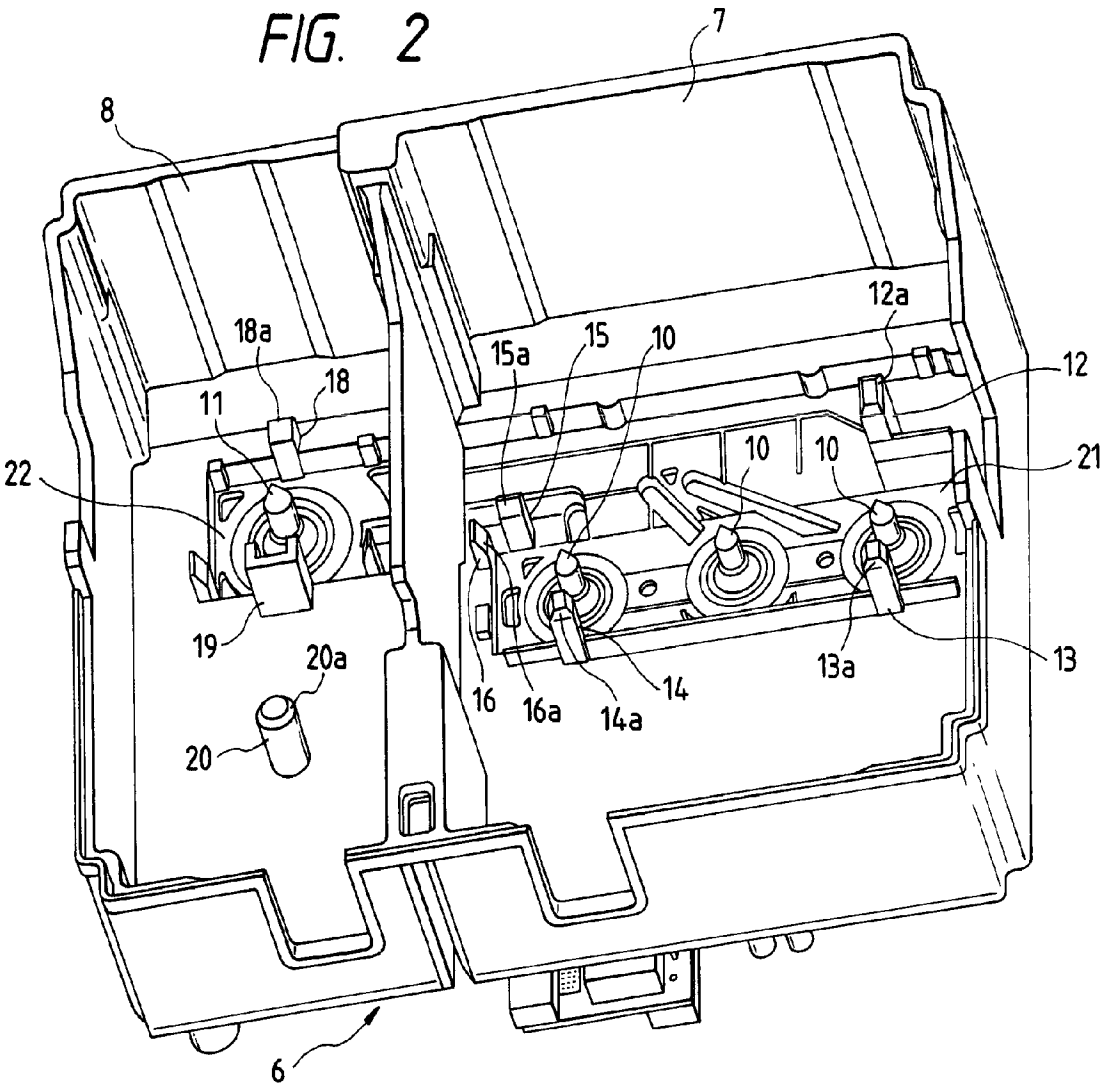
FIG. 2 is a perspective enlarged view of a carriage and a cartridge holder mounting an ink cartridge thereon according to the present invention.
Figure 3:
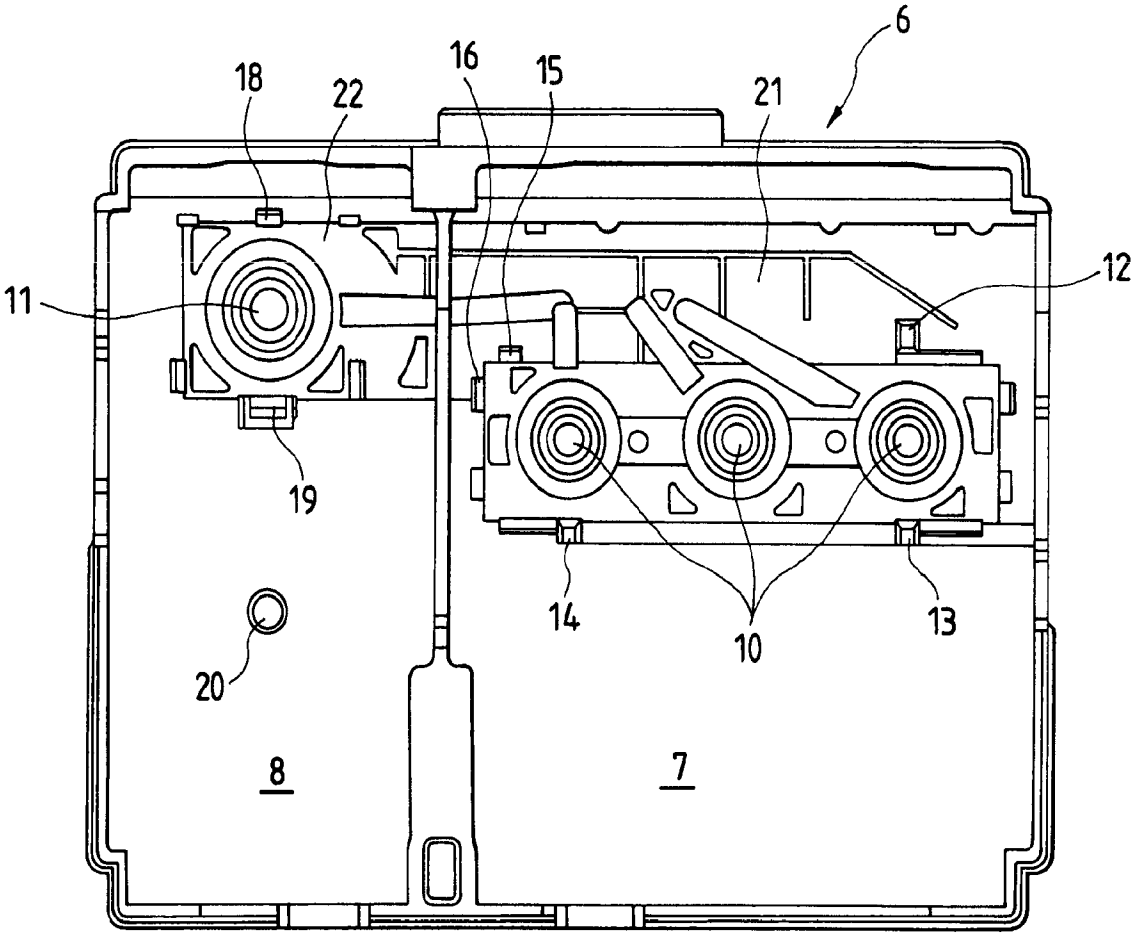
FIG. 3 is a top plan view of the carriage and the cartridge holder shown in FIG. 2.

FIGS. 2 and 3 show an embodiment of the cartridge holder 6 mounted on carriage 3 and in this embodiment, a color ink cartridge housing chamber 7 and a black ink cartridge housing chamber 8 are formed on a bottom 202 of cartridge holder 6. Ink supply needles 10 and 11 respectively communicating with the print head 23 are planted in respective positions opposite to the respective ink supply ports of the ink cartridges which are properly installed.

Rectangular recessed sections 21 and 22 are formed so that they respectively surround the periphery of these ink supply needles 10 and 11. In the vicinity of the ink supply needles 10, projections 12, 13, 14, 15 and 16, each tip end 12*a*, 13*a*, 14*a*, 15*a*, and 16*a* of which is slightly higher than that of each ink supply needle 10, are formed approximately along the walls of the recessed part 21, at four corners of an area in which the ink supply needles 10 are arranged so that the bottom of the ink cartridge can be horizontally supported.

In the meantime, in the vicinity of the ink supply needle 11, first and second projections 18 and 19, each upper end 18*a* and 19*a* of which is slightly higher than the end of the ink supply needle 11, are formed so that the ink supply needle 11 is put between the projections. A third projection 20 is formed in the center of floor 202 within chamber 8. The second projection 19 is formed wider to the extent that the bottom of the ink cartridge can be horizontally supported when the ink cartridge is installed in a wrong direction.

Figure 4:
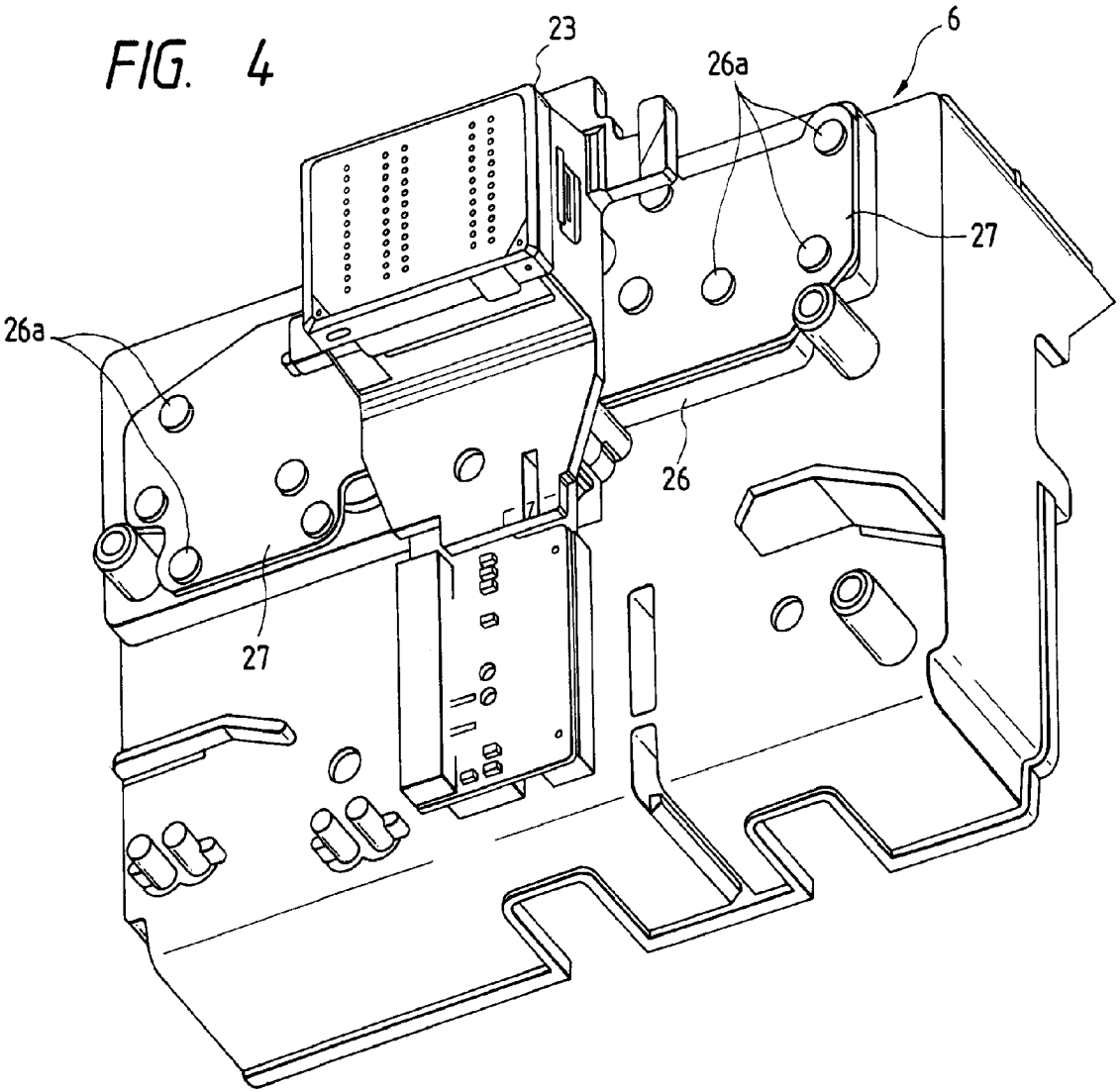
FIG. 4 is a perspective view showing the structure of the rear side of the above cartridge holder shown in FIGS. 2 and 3.

FIGS. 4(*a*), 5(*a*) and 5(*b*) show the structure of the rear side of cartridge holder 6. A passage forming part 26 is formed on bottom 202 defines the recessed sections 21, 22 within cartridge 6 communicating passages 24 and 25 for connecting each of the ink supply needles 10 and 11 and the print head 23 protrude from bottom 202. The upper surface of bottom 202 is sealed by a sealing plate 27 and the print head 23 is laminated and fixed on the upper surface of bottom 202.

Figure 5A:
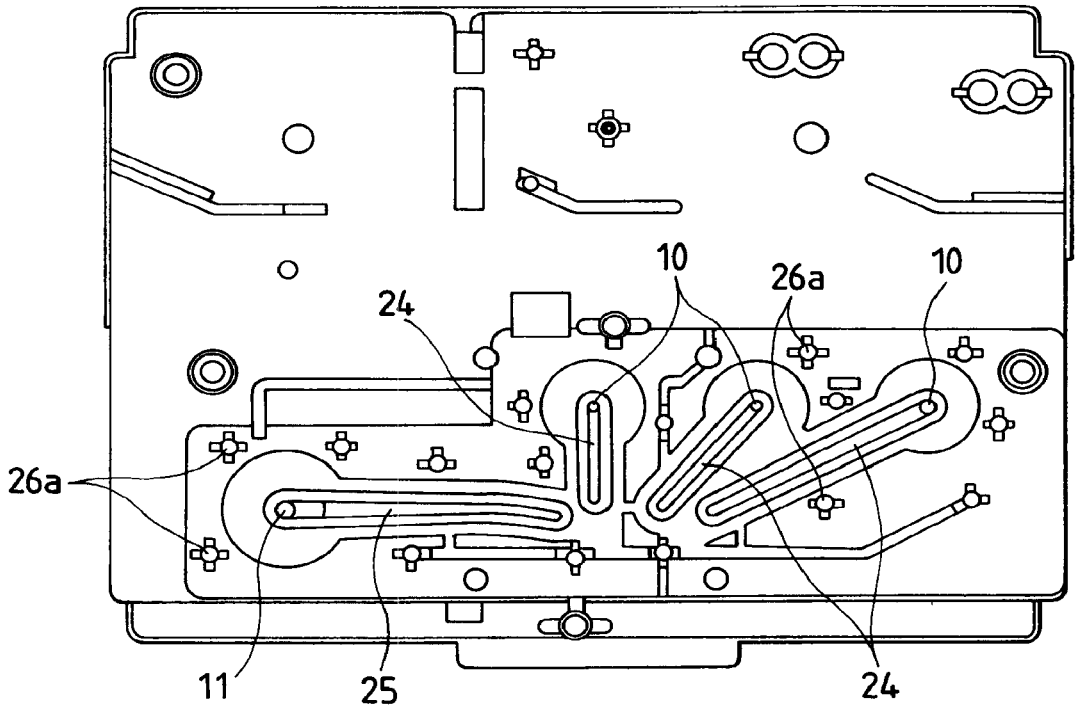
FIG. 5(*a*) is a top plan view showing the cartridge holder in a state where a print head and a sealing plate are detached therefrom.
Figure 5B:
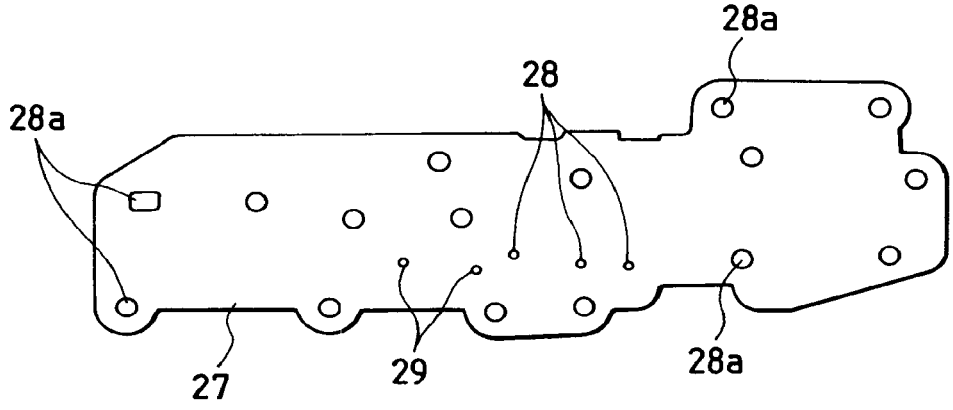

In the passage forming part 26, caulking ribs 26*a* are formed together with the communicating passages 24, 25 by injection molding and the like as shown in FIGS. 5(*a*), 5(*b*). Through holes 28 and 29 respectively connecting to the print head and caulking holes 28*a* are also formed on the sealing plate 27 and both are fixed to carriage 6 in a fluid-tight state by caulking. The print head 23 is mounted on the sealing plate in a state in which its ink inlets respectively communicate with the through holes 28 and 29 of the sealing plate.

Figure 6A:
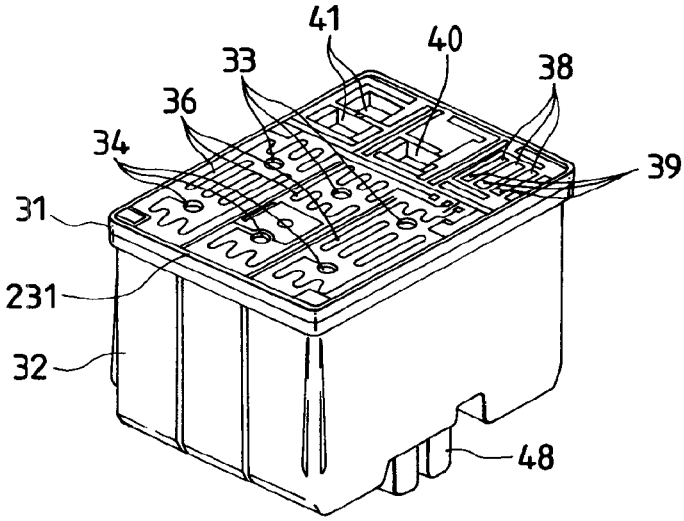
FIGS. 6(*a*) to 6(*c*) are perspective views of a color ink cartridge according to one embodiment of the present invention respectively showing the structure of the upper surface of a lid in a state in which a film is detached, the structure on the side of an ink supply port and the structure of the upper surface of the lid in a state in which the film is present.
Figure 6B:
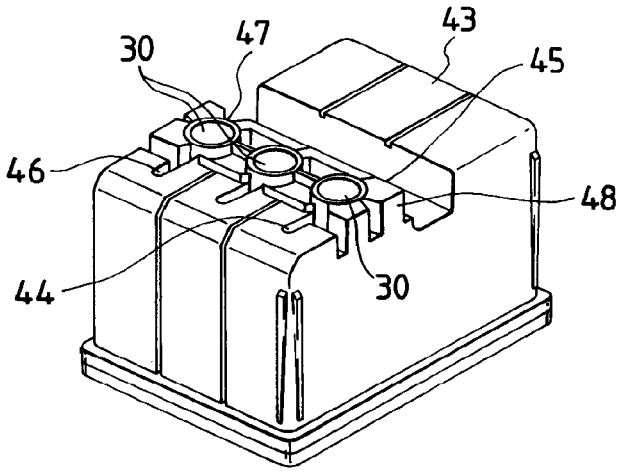
Figure 6C:
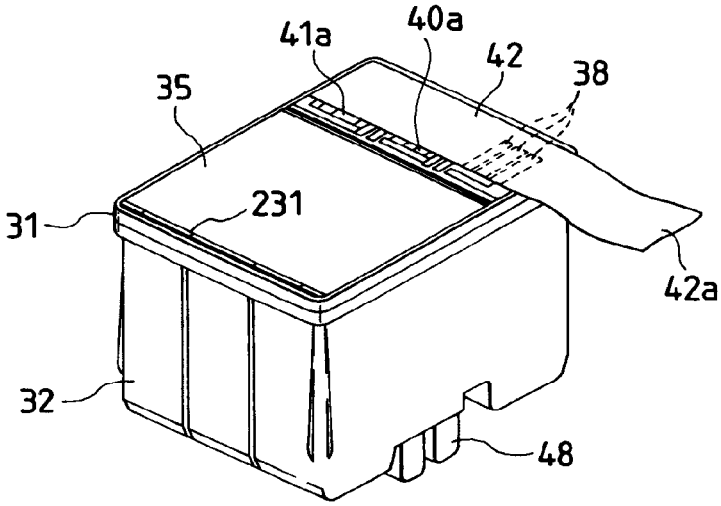

FIGS. 6(*a*) to 6(*c*) are perspective views showing an embodiment of a color ink cartridge. The color ink cartridge 206 is formed as a container 32 on one side of which ink supply ports 30 where the ink supply needles 10 of the printing apparatus are respectively inserted are formed. The opposite open face container 32 is sealed by a lid 31, and a porous body impregnated with ink is housed inside the color ink cartridge 206.

Figure 8:
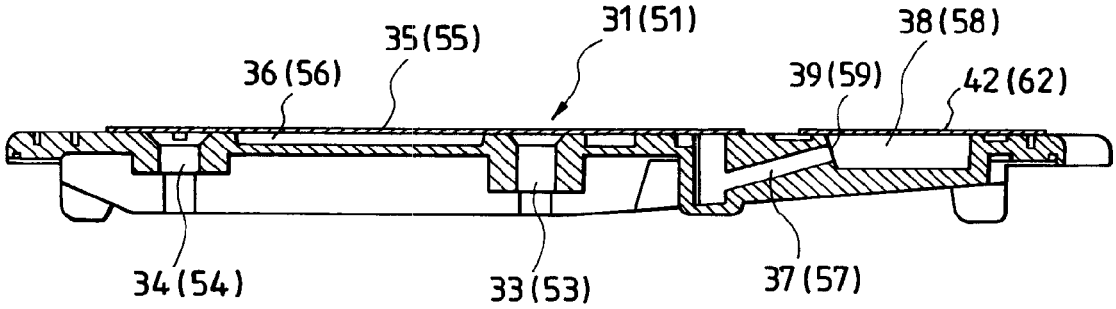
FIG. 8 is a side sectional view showing the structure of the ink cartridge lid.

Ink inlets 33 and air communicating ports 34 are formed on the surface of the lid 31 and each air communicating port 34 is connected to one end of a fine, circuitous groove 36 sealed by a sealing film 35. The fine groove 36 generates the capillary action. The other end of the fine groove 36 communicates with an air communication opening 39 formed in a recessed part 38. As shown in FIG. 8, the recessed part 38 is connected with the other end of the fine groove 36 through a communicating (or tunnel) passage 37 formed as a through hole and extends approximately horizontally inside the thickness of the lid 31. According to an arrangement, the tunnel passage 37 is designed to incline from the air communication opening 39 formed in the recessed part 38, so that no part of the air communication passage, including fine groove 36, tunnel passage 37 and the recessed part 38 does pass in the interior side of the lid 31 of the ink cartridge. In other words, the depth of tunnel 37 is shorter than the thickest part of lid 31.

As shown in FIG. 6(*c*), the sealing film 35 has a size which is equal to or slightly smaller than an area defined by a rectangular recess 231 formed in the edge of the lid 31, so that the four edges of the sealing film 35 are bent down into the recess 231. Owing to the design, the sealing film 35 is hardly peeled off when a user touches the ink cartridge when mounted on the printer.

A recessed part 40 for fitting to the projection of a lever 4 is formed on the center line of the lid 31 and a recessed part 41 for securing negative-pressure volume is formed in a residual part of lid 31. The recessed parts 38 are completely sealed by a film 42, one end 42*a* of which is extended outside the lid 31 which can be peeled. The recessed parts 40 and 41 are partly sealed by the same film 42 in a state in which openings 40*a* and 41*a* for communicating with the air are formed respectively in a portion of recessed parts 40, 41 which remains uncovered.

A convex portion 48 which is adapted to touch to the inner wall of the recessed part 21 of the cartridge holder 6 when the cartridge is properly positioned in cartridge 6 protrudes from bottom 43. Cartridge 6 is provided with a shape into which the convex portion can be inserted. Ink supply ports 30 for respectively fitting to the ink supply needles 10 are provided at the convex portion 48. Recessed parts 44-47 formed on bottom 43 for receiving projections 12 to 16 on the side of the cartridge holder 6. Recessed parts 44-47 are formed so that these ink supply ports 30 are put between the diagonal points of an imaginary quadrilateral.

Figure 7A:
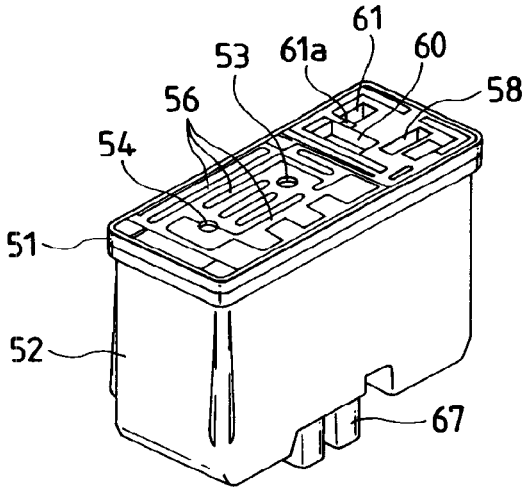
FIGS. 7(*a*) to 7(*c*) are perspective views of a black ink cartridge according to another embodiment of the present invention respectively showing the structure of the upper surface of a lid in a state in which a film is detached, the structure on the side of an ink supply port, and the structure of the upper surface of the lid in a state in which the film is present.
Figure 7B:
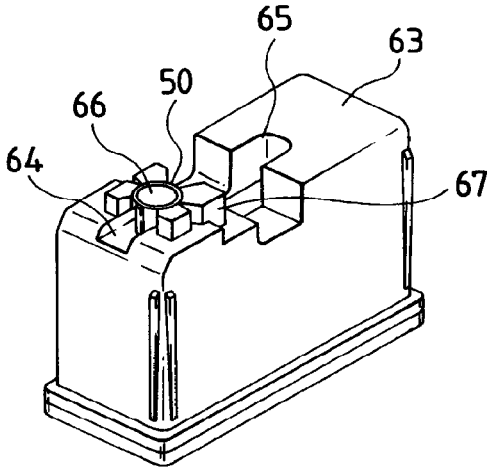
Figure 7C:
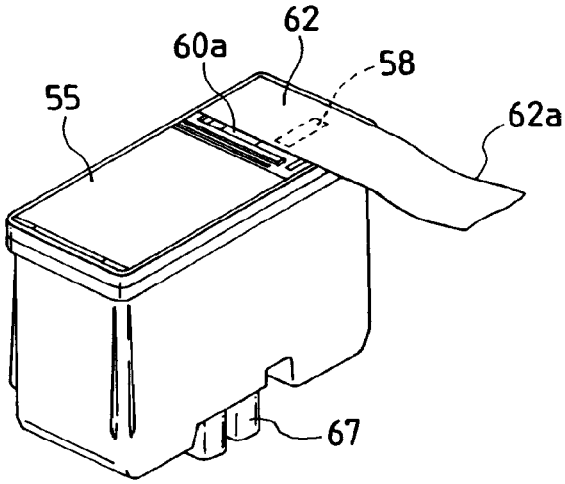

A black ink cartridge 208 includes a container 52 on one side of which an ink supply port 50, where the ink supply needle 10 of the printing apparatus is inserted, is formed. The opposite open face of container 52 is sealed by a lid 51 as shown in FIGS. 7(*a*)-(*c*). A porous body impregnated with ink is housed inside the black ink cartridge 208.

An ink inlet 53 and an air communicating port 54 are formed on the surface of the lid 51. Air communicating port 54 is connected to one end of a fine groove 56 sealed by a film 55 to form a capillary. The other end of the fine groove 56 communicates with an opening 59. Opening 59 communicates with a recessed part 58, formed on the side of the other end. Passage 57 is formed as a through hole and extends approximately horizontally inside the lid 51 as shown in FIG. 8. Each through hole respectively forming the above communicating passages 37 and 57 is tilted so that each side of the recessed parts 38 and 58 is slightly higher so as to enable puffing out a pin in injection molding.

A recessed part 60 for fitting to the projection of the lever 5 is formed on the center line of the lid 51 and a recessed part 61 for securing negative-pressure volume is formed in a residual part.

The recessed part 58 is completely sealed by a film 62, one end 62*a* of which extends beyond an edge of the lid 51, and can be peeled off when used. The recessed part 60 is partly sealed by the same film 62 in a state in which a part 60*a* communicates with the air. The recessed part 61 communicates with the recessed part 60 via a recessed part 61*a*.

Figure 31:
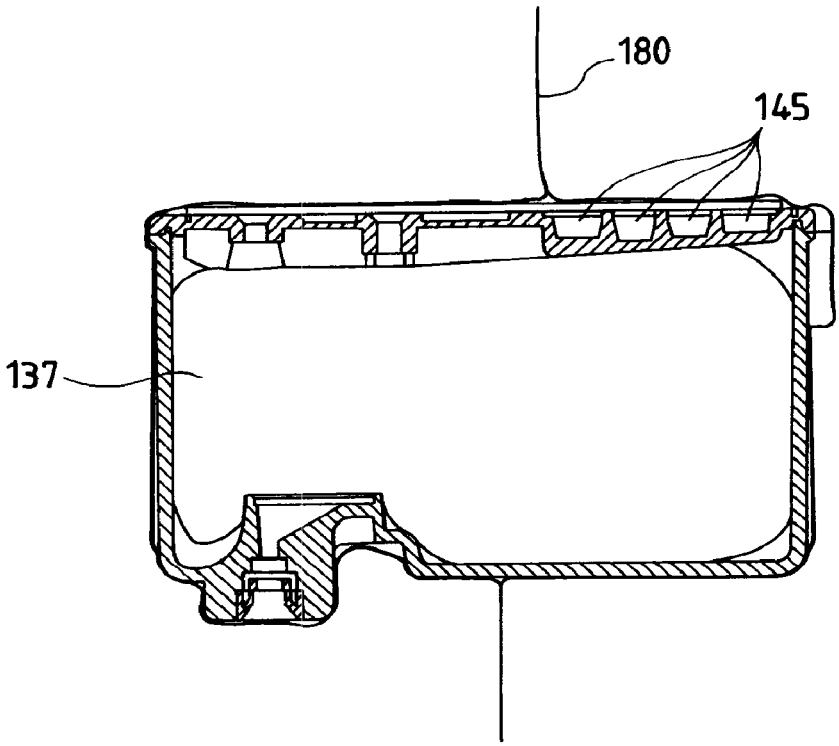
FIG. 31 is a side sectional view showing an ink cartridge which is packed under a vacuum condition.

As described above, even if the ink cartridge is packed and vacuumed, a package having film 42 or 62 sealing the recessed part 41 or 60 in a state in which space for decompression can be prevented from being blocked by the package. Specifically, when the ink cartridge is enclosed in a flexible package 180, such as an aluminum layered package, or vinyl made package and sealed under vacuum condition as shown in FIG. 31, air transfer occurs between the ink chamber 137 and the recessed parts 145 formed on the lid of the cartridge. That is, gas contained in ink or gas generated when ink component is dissolved moves into the recessed parts 145. Accordingly, no air bubble would be created in the ink even when the ink cartridge is stocked in a warehouse for a long time.

In the meantime, on the side of container 52 opposite to the lid 51, a convex portion 67 protrudes from bottom 63 and is provided with a shape approximately equivalent to the inner wall of the recessed part 22 of the cartridge holder 6. The ink supply port 50, for fitting to the ink supply needle 11, is provided in the convex portion 67. Recessed parts 64 and 65 are formed at the front side and the rear side of the ink supply port 50 in such a manner that the ink supply port 50 is located between the recessed parts 64 and 65. Recessed parts 64 and 65 receive projections 18, 19 and 20 on cartridge holder 6.

Next, a process for inserting the ink cartridge composed as described above will be described by the example of the black ink cartridge to simplify the description.

Figure 9A:
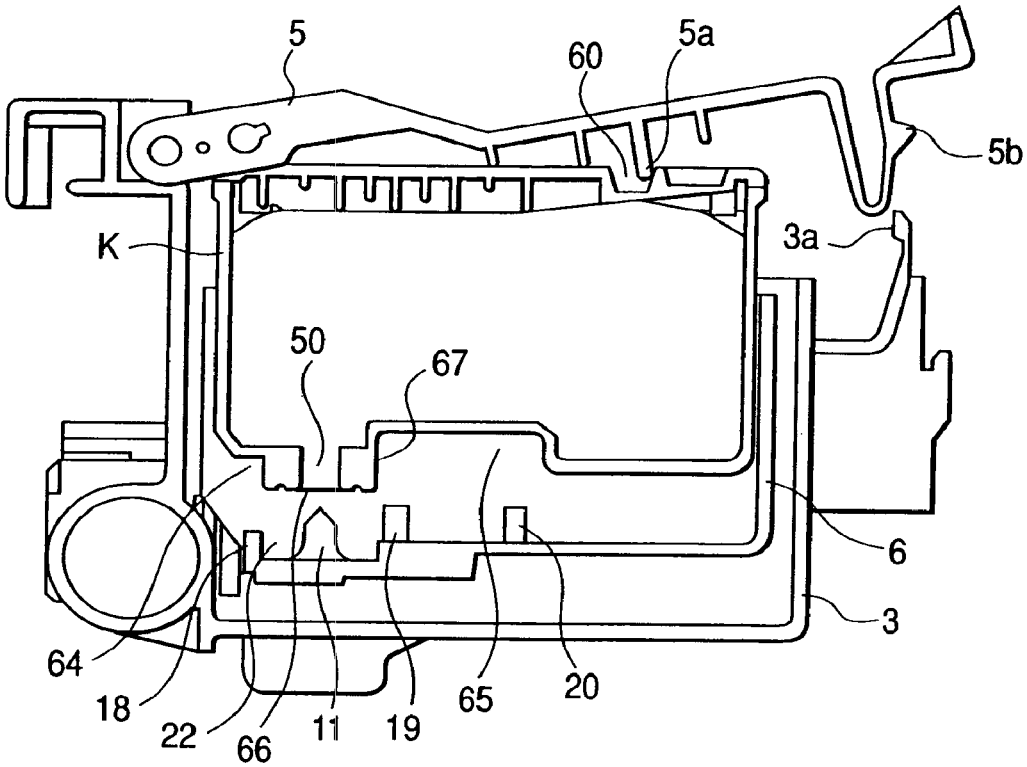
FIGS. 9(*a*) and 9(*b*) are side sectional views demonstrating installation of the ink cartridge in the cartridge holder.

When an ink cartridge K is taken out of a package which maintains the cartridge under negative pressure in the process of distribution, and the film 62 which can be peeled off is removed, the air communicating opening 59 becomes open to the air and the recessed part 60 is also exposed. If the black ink cartridge K is installed in a proper direction of the cartridge holder 6, the recessed parts 64 and 65, formed on the bottom 63, are opposed to the projections 18 to 20 of the holder 6 as shown in FIG. 9*a*.

When the lever 5 attached to the holder 6 is operated in this state, the projection 5*a* of the lever 5 is received by the recessed part 60 of the lid 51. Lever 5 pushes down the cartridge K. In the process of push down, the projections 18, 19 and 20 of the holder 6 are respectively first fitted into the recessed parts 64 and 65 of the cartridge K and the cartridge K is guided to a normal position by a slant face of tip 18*a* formed at the end and a tapered part of tip 20*a*.

Figure 9B:
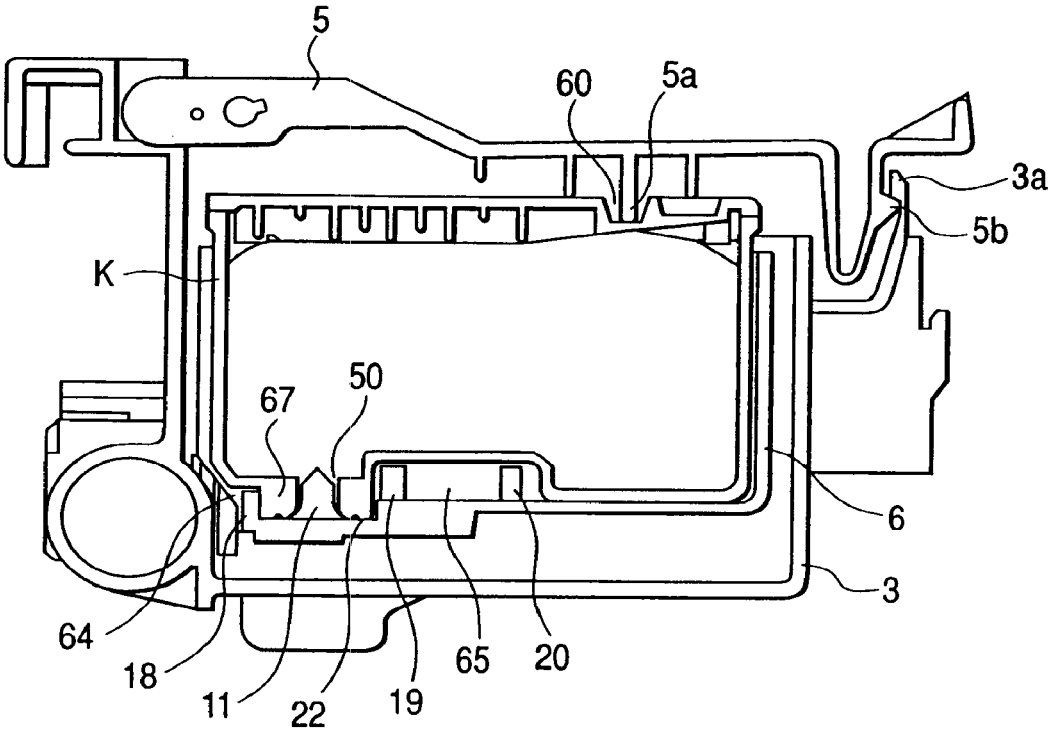

When the cartridge K is further pushed down, the ink supply needle 11 pierces the film 66 sealing the ink supply port 50 and is inserted into the ink supply port 50 as shown in FIG. 9*b*. The lever 5 is pivoted to a normal position and a fitting part 5*b* slides past and is fixed to a hook 3*a* of the carriage 3. As the convex portion 67, in which the ink supply port 50 is formed, is fitted into the recessed part 22 of the cartridge holder 6 and caught, the printing apparatus is prevented from rattling due to vibration and the like when the cartridge K is installed in a proper position, and the leakage of ink and the application of unnecessary external force to the ink supply needle are securely prevented.

Figure 10A:
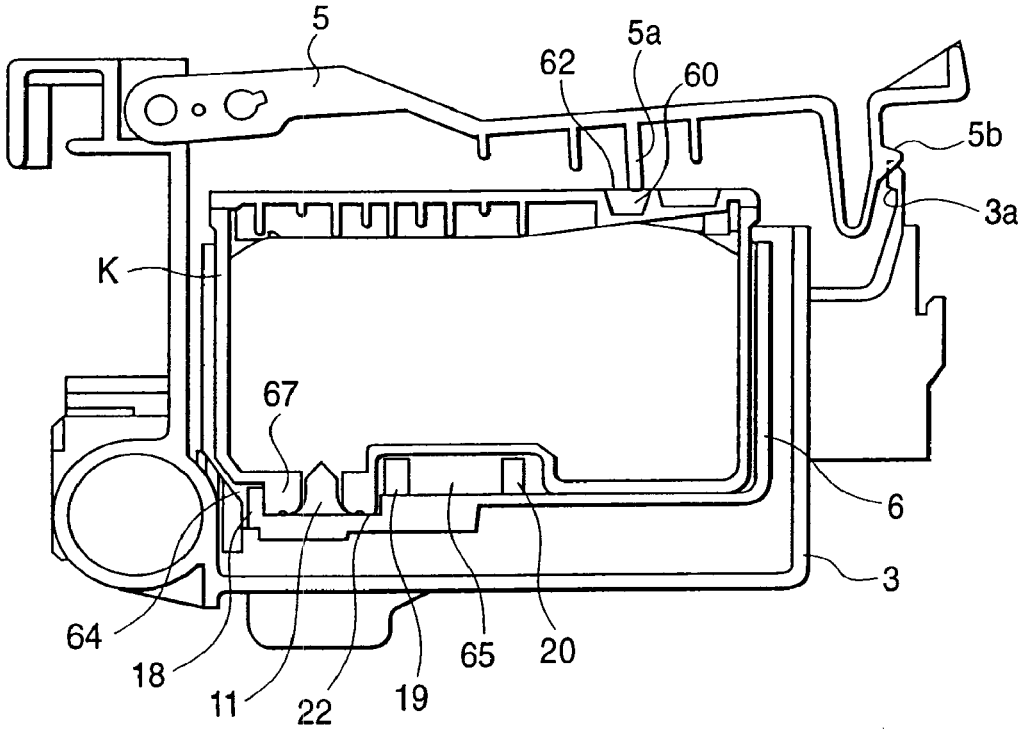
FIGS. 10(*a*) and 10(*b*) are side sectional views of an improperly mounted ink cartridge within the cartridge holder respectively showing a state in which the ink cartridge is installed with the film of the ink cartridge not peeled off and a state in which the ink cartridge is installed in a reverse direction.

As the projection 5*a* of the lever 5 comes into abutment against the film 62 and lifted, as shown in FIG. 10*a*, even if the ink cartridge K is installed in a proper posture when film 62 has not been peeled projection 5*a* is stopped and the fitting part 5*b* does not reach the hook 3*a* of the carriage 3 and the lever 5 cannot be fixed to the carriage 3. If a user notices it, he or she peels off the left film 62 and reinstalls the ink cartridge K. Therefore, a failure of ink supply during printing caused because a user forgets to peel the film 62 can be prevented beforehand.

Figure 10B:
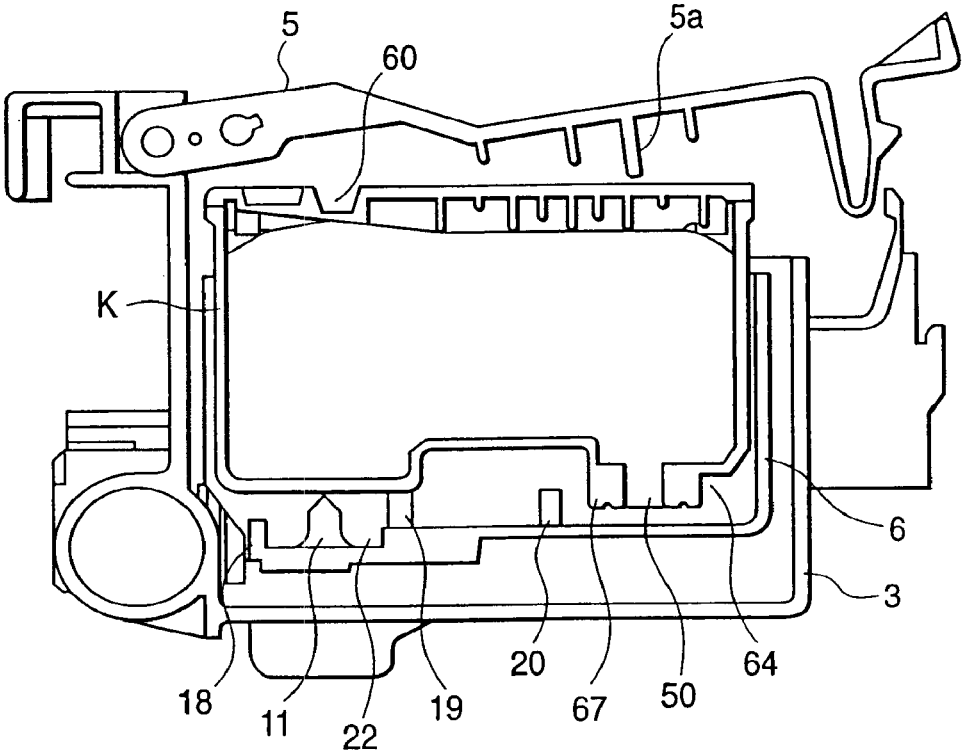

In the meantime, if the black ink cartridge K is installed in the improper way as shown in FIG. 10*b*, the bottom 63 is opposed to the wide projection 19 and is supported in a position higher than the end of the ink supply needle 11 in an approximately horizontal posture. As the ink cartridge K does not lower due to the projection 19 even if the lever 5 is turned in this state, the ink supply needle 11 is prevented from being broken.

In the case of the color ink cartridge, printing in a state in which the film 42 is not peeled is also prevented by the similar action and if the color ink cartridge is installed in a wrong direction, the breakage of the ink supply needle 10 is prevented because the projection 12 comes first into abutment against the bottom 43 and prevents the bottom from lowering.

Figure 11A:
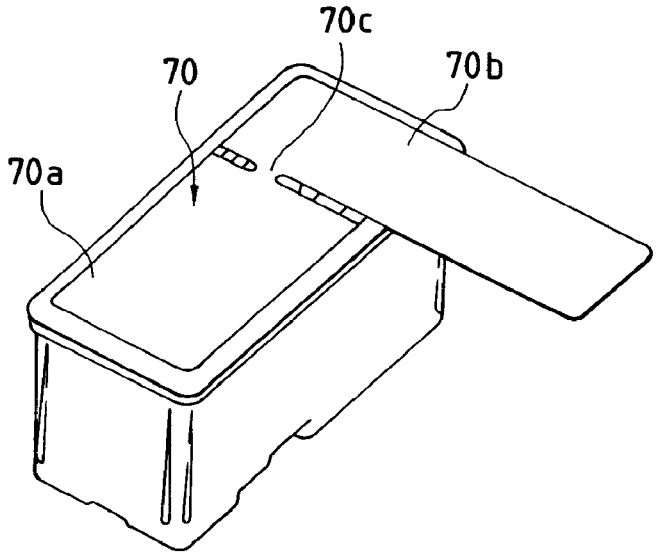
FIGS. 11(*a*) to 11(*c*) show other methods of sticking a sealing film for sealing the lid according to the present invention.
Figure 11B:
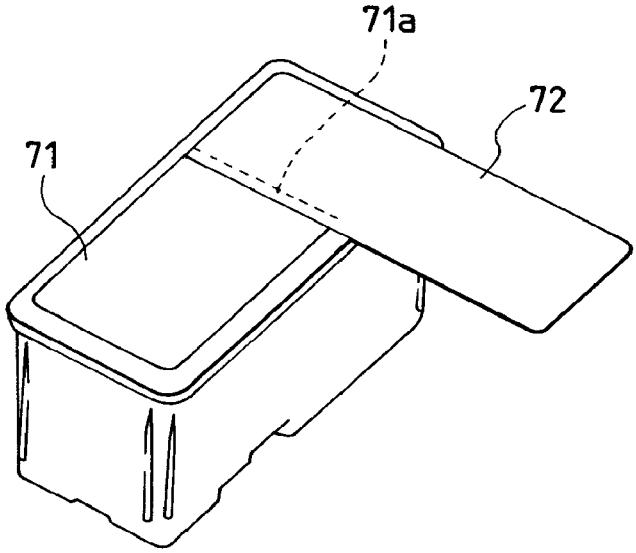
Figure 11C:
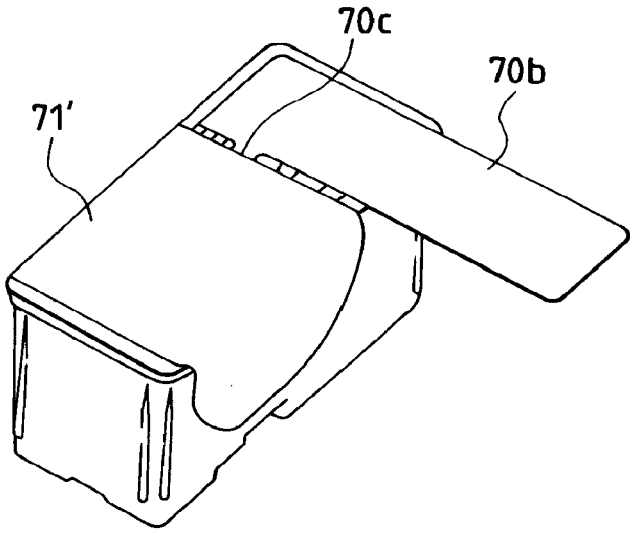

In the above embodiments, the films 35 and 55 forming a capillary together with the fine groove 56 and the films 42 and 62 which are peeled to provide communication with the air during use are respectively independently stuck on the lids 31 and 51. However, even if an integrated film 70 in which an area 70*a* forming a capillary and an area 70*b* to be removed in use are connected via a narrow part 70*c* which can be torn off as shown in FIG. 11*a*, or a film 71 forming a capillary and a film 72 to be peeled off overlapping with the film 71 in a part 71*a* as shown in FIG. 11*b* are respectively stuck, the similar action is produced. Further, if a second film 71' is affixed as shown in FIG. 11*c* so that the surface of the lid is at least covered in the area 70*a* forming a capillary, ink can be securely prevented from being evaporated.

Figure 32:
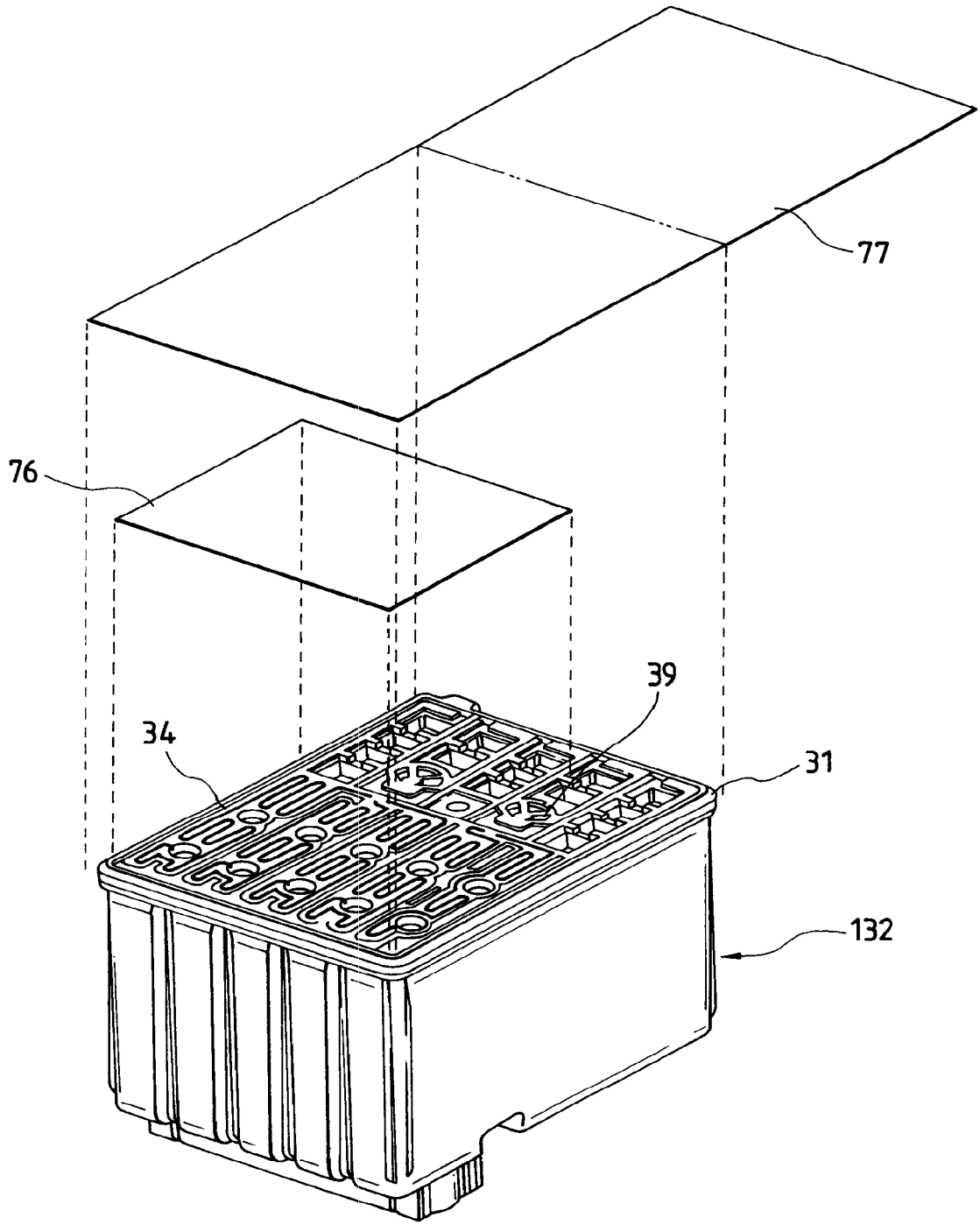
FIG. 32 is a perspective view showing an ink cartridge with two separate sealing films according to an arrangement of the invention.

According to another arrangement of the invention, as shown in FIG. 32, a first sealing film 76 covers fine, circuitous grooves 34 formed on a lid 31 of the ink cartridge 132 whereas a second sealing film 77 covers entire surface of the lid 31 over the first sealing film 76 not only air communication holes 39. The second sealing film 77 may be peeled off when the ink cartridge is in use. The first sealing film 76 and the second sealing film 77 may have different colors from each other or formed from different material. This arrangement may be advantageous in that a user can easily recognize that which sealing film is to be peeled off.

Figure 12:
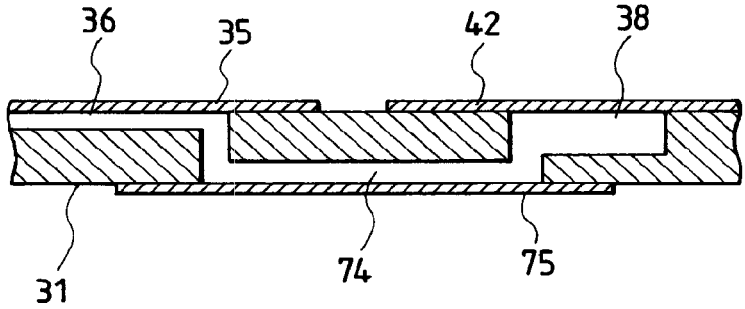
FIG. 12 is a sectional view of a cartridge lid showing another embodiment of a communicating passage formed therein according to the present invention.

Also, in the above embodiments, the communicating passages 37 and 57 are respectively formed as a through hole approximately horizontally extending, though it is slightly tilted. However, even if one end of a fine groove 36 composing a capillary pierces a lid 31, a fine, circuitous groove 74 is formed so that the fine groove 36 communicates with a recessed part 38 for opening to the air and the fine groove 74 is covered by a sealing film 75 as shown in FIG. 12, the similar action is produced. According to this embodiment, when through holes to the communicating passages 37 and 57 are formed, work for inserting/extracting a pin required in an injection molding process is not required and a process for forming the lid can be simplified.

Figure 13:
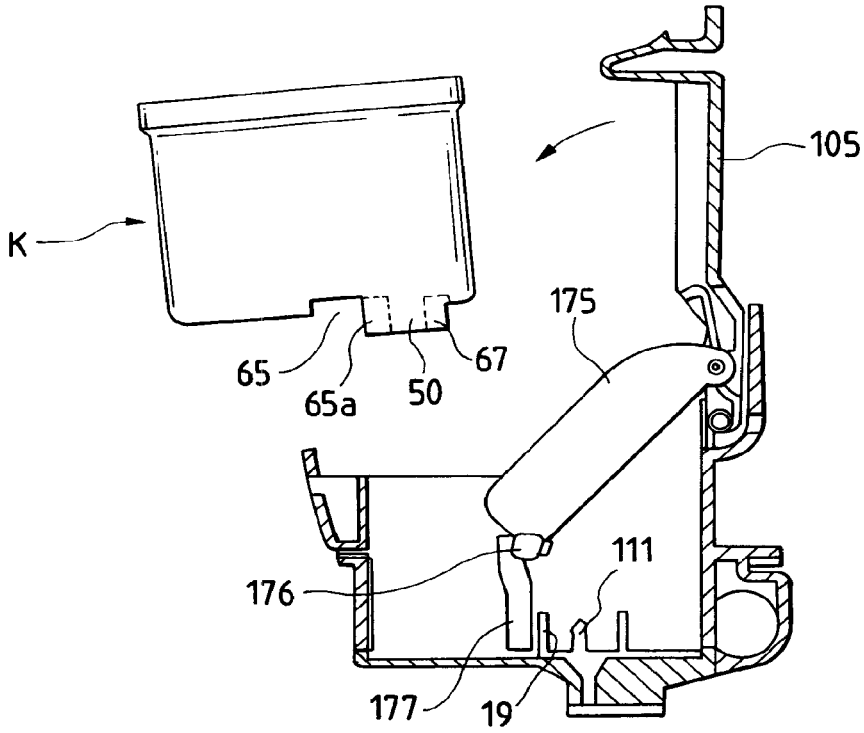
FIG. 13 is a side sectional view showing another embodiment of a mechanism for installing an ink cartridge.
Figure 14A:
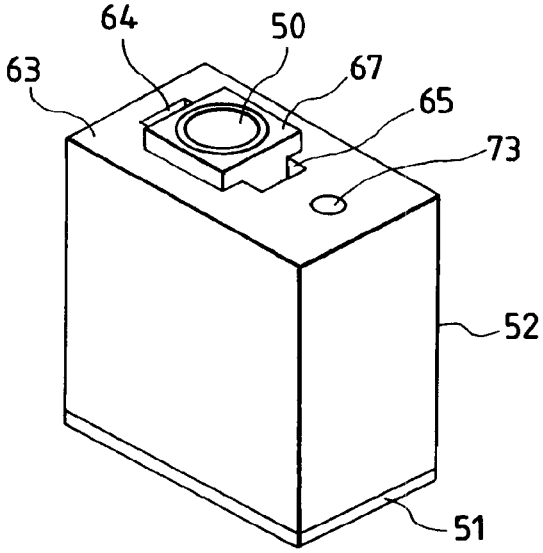
FIGS. 14(*a*) and 14(*b*) are respectively a perspective view and a top plan view showing another embodiment of the ink cartridge.
Figure 14B:
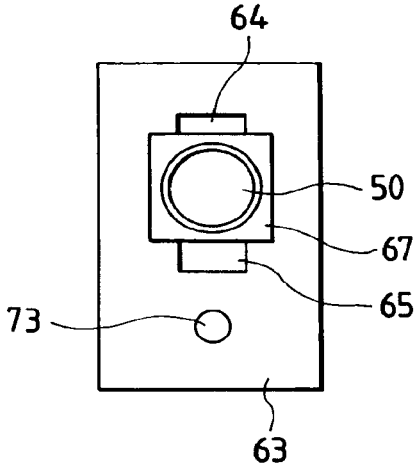

As shown in FIG. 13, in a second embodiment, the recessed part 65 for fitting to the projection 19 is integrated with the recessed part for fitting to the projection 20 to install or detach the cartridge K in or from the carriage or the cartridge holder 6 by a mechanism in which a lifter 176 connects to the lever 105 via an operating rod 175 as shown in FIG. 13. In the present embodiment, the lifter 176 is guided up and down along a guide groove 177 by the operation of the lever 105, so that the ink cartridge is attached to or detached from the cartridge holder 106. In the operation, the projection 19 engages with and disengages from one recessed part 65*a* of the ink cartridge so that the ink cartridge can be accurately positioned as mentioned above. However, in the case of an ink cartridge mounted or detached by a lever not provided with the lifter 176, even if recessed parts 64 and 65 are formed as shown in FIGS. 14(*a*), 14(*b*), so that a convex portion 67, in which the ink supply port 50 is formed, is located between the recessed parts 64, 65 and a recessed part 73 is independently formed in a position opposite to the convex portion 20 of the cartridge holder, the similar action is produced.

Figure 15A:
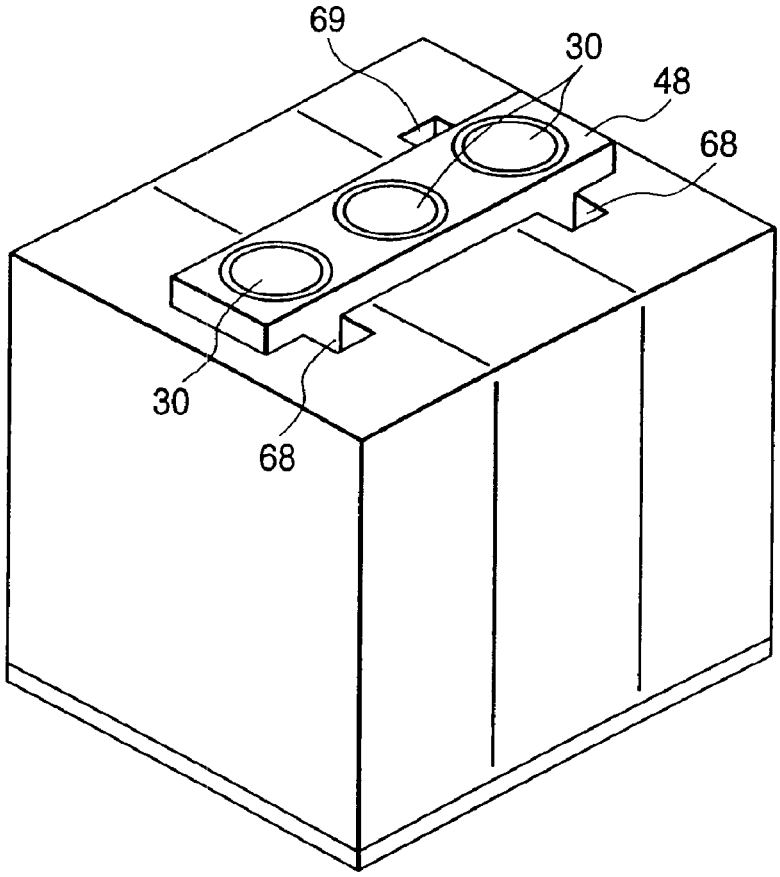
FIGS. 15(*a*) and 15(*b*) are respectively a perspective view and a bottom plan view showing a further embodiment of the ink cartridge.
Figure 15B:
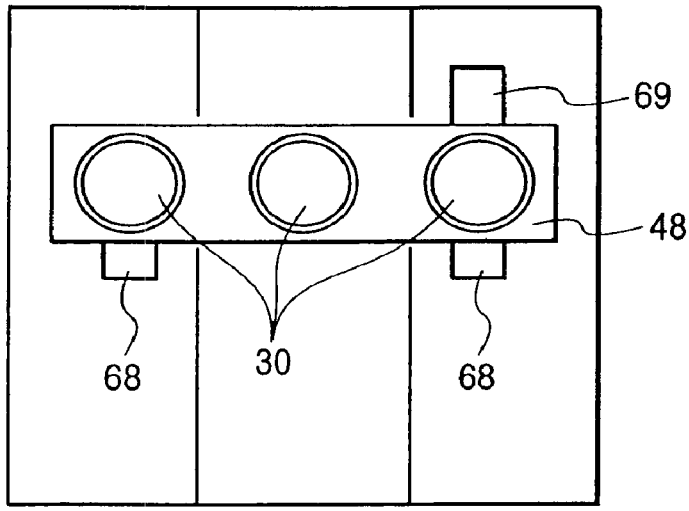

Reference is now made to FIGS. 15(*a*) and 15(*b*) in which another embodiment of the invention is provided. Ink cartridge 212 paired with such a black ink container, it is desirable that recessed parts 68 are formed along one wall of a convex portion 48 in which the ink supply port 30 is formed and on the side of the cartridge so that as a large interval as possible is provided between recessed parts 68. A recessed part 69 is formed on the other side, across the convex portion 48, so that the recessed part 69 is opposite to at least one recessed part 68.

Figure 16A:
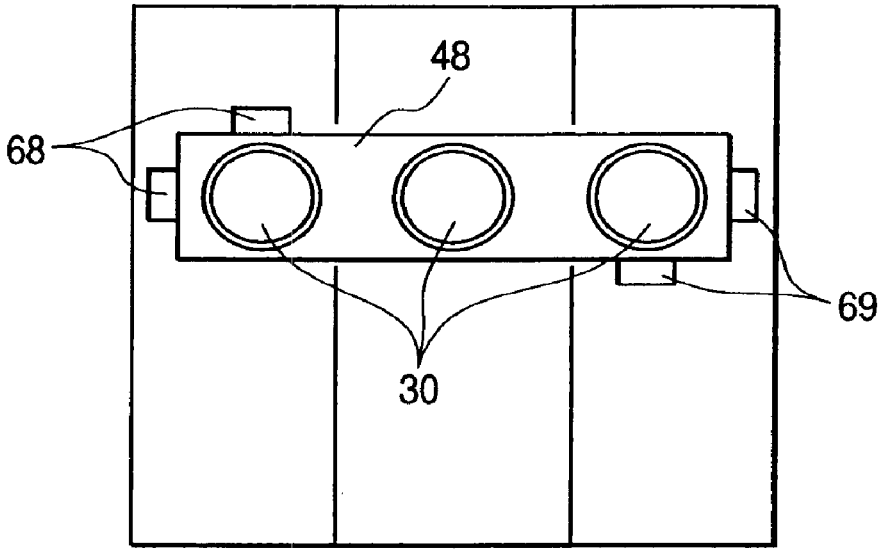
FIGS. 16(*a*) and 16(*b*) are respectively a top view plan showing a structure in which recessed parts are arranged and a top view plan showing the structure of a convex part in the vicinity of an ink supply needle and corresponding to the recessed parts respectively in accordance with another embodiment of the color ink cartridge according to the present invention.
Figure 16B:
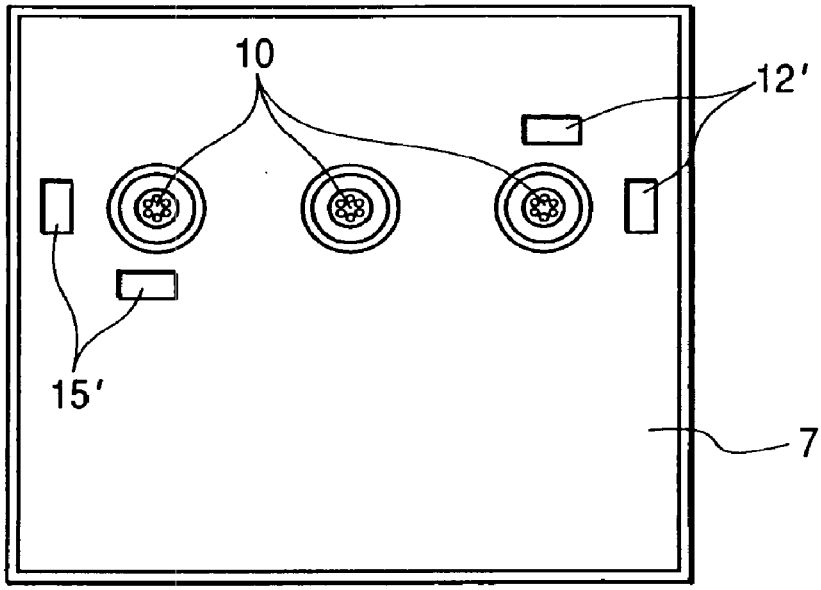
Figure 17A:
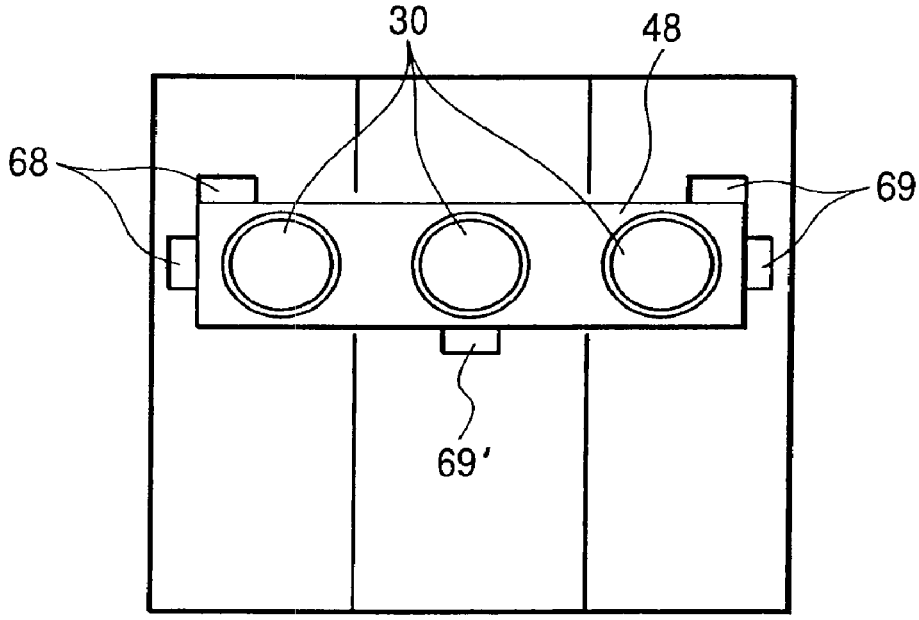
FIGS. 17(*a*) and 17(*b*) are respectively a top view plan showing structure in which recessed parts are arranged and a top plan view showing the structure of a convex part in the vicinity of an ink supply needle and corresponding to the recessed parts respectively in still another embodiment of the color ink cartridge according to the present invention.
Figure 17B:
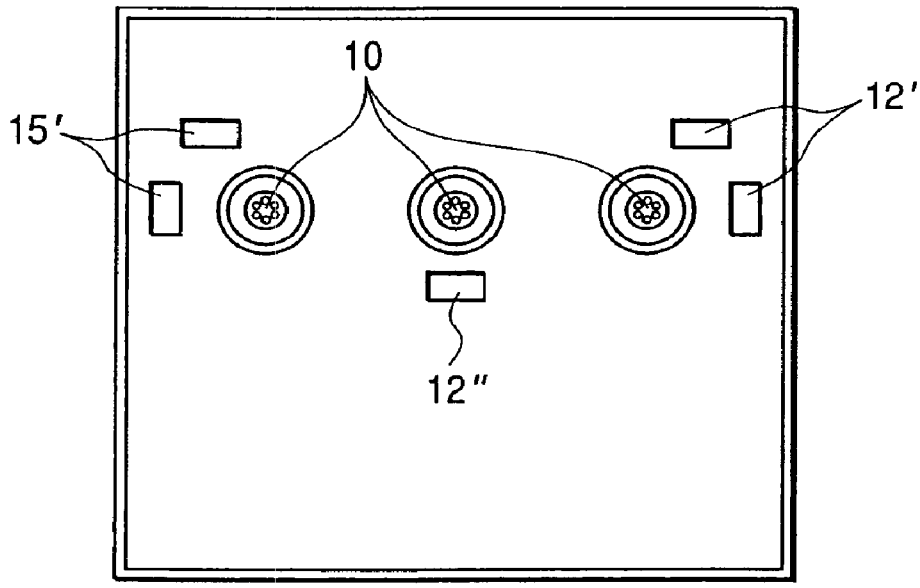

As described above, if the relationship between another member and the recessed part is not required to be considered, recessed parts 68 and 69 are located at the diagonal points of a convex portion 48 as shown in FIG. 16(*a*), and formed so that they are close to the wall of the convex portion 48 in a color ink cartridge. Convex portions 12' and 15' may also be formed in the color ink cartridge housing chamber 7 of the holder 6 so that the convex portions 12', 15' respectively correspond to the recessed parts 68 and 69. If necessary, in yet another embodiment a recessed part 69' may be also formed at a center position along the wall, on which no recessed part exists, of the convex portion 48 where the ink supply port 30 is formed with the recessed part 69' close to the wall of the convex portion 48 as shown in FIG. 17(*a*).

A convex portion 12" corresponding to the recessed part 69' is formed in holder 6 corresponding to the above ink cartridge. Hereby, the ink cartridge can be more securely prevented from being improperly inserted by the convex portions 12', 12" and 15' arranged around the ink supply needle 10.

Figure 18A:
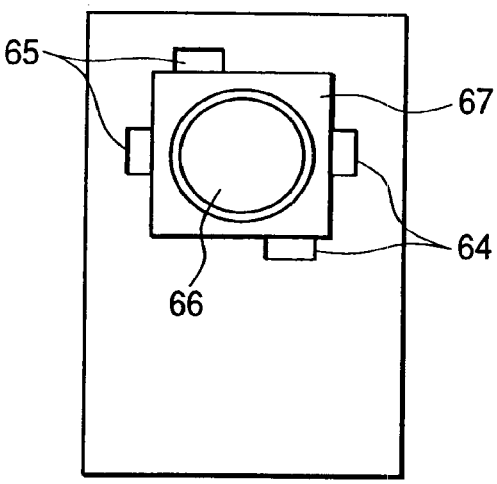
FIGS. 18(*a*) and 18(*b*), FIGS. 19(*a*) and 19(*b*), FIGS. 20(*a*) and 20(*b*), and FIGS. 21(*a*) and 21(*b*) are respectively top plan view showing structure in which recessed parts are arranged and top plan view showing the structure of a convex part in the vicinity of an ink supply needle and corresponding to the recessed parts respectively in still other embodiments of the black ink cartridge according to the present invention.
Figure 18B:
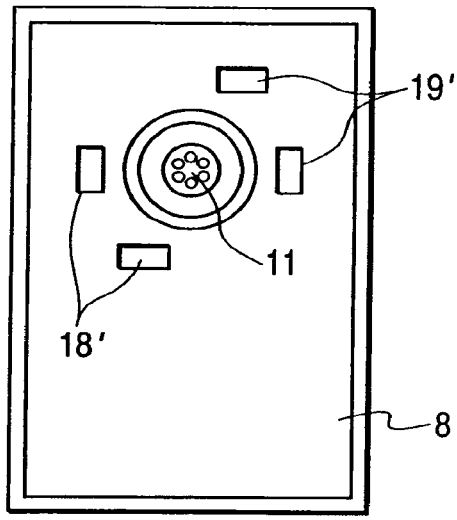

The above embodiment relates to the color ink cartridge, however, as for a black ink cartridge paired with it, embodiments shown in FIGS. 18(*a*) to 21(*b*) are also desirable.

Figure 19A:
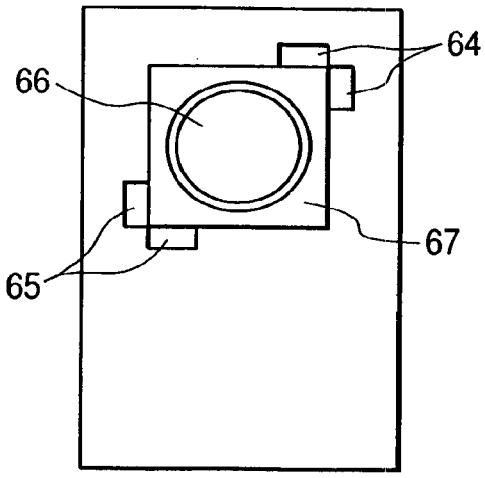
Figure 19B:
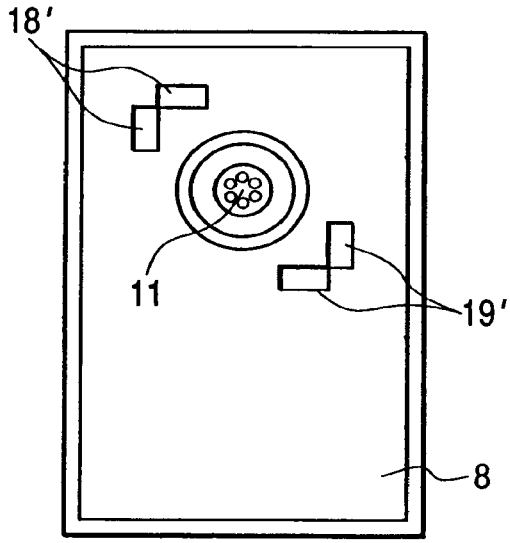
Figure 20A:
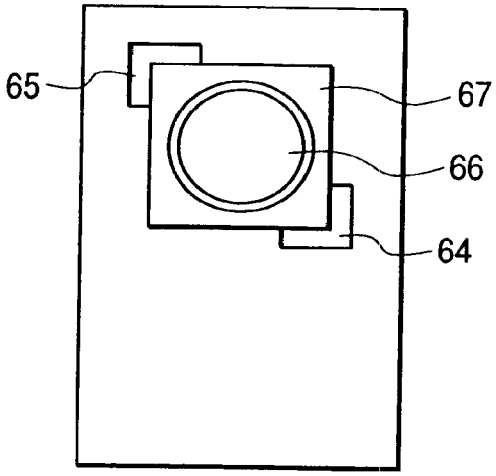
Figure 20B:
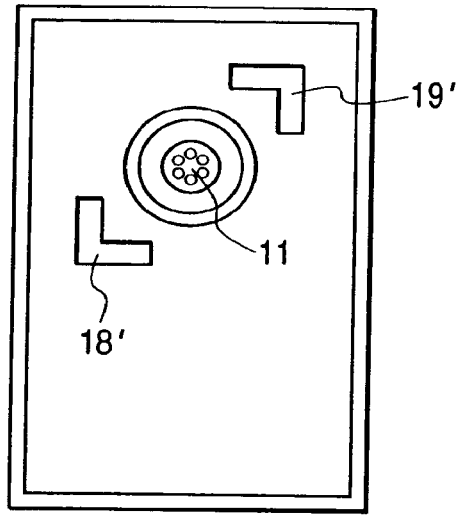

That is, in an embodiment shown in FIG. 18(*a*), recessed parts 64 and 65 are located at the diagonal points of a convex portion 67 and formed so that they are close to the wall of the convex portion 67, while convex portions 18' and 19' are formed corresponding to these recessed parts 64 and 65 in the ink cartridge housing chamber 8 of the holder 6 as shown in FIG. 18(*b*). A pair of adjacent recessed parts 64 and a pair of adjacent recessed parts 65 are located at diagonal points as shown in the embodiment of FIG. 19(*a*), while convex portions 18' are formed adjacently and convex portions 19' are formed adjacently respectively corresponding to the recessed parts 64 and 65 as shown in FIG. 19(*b*) in the ink cartridge housing chamber 8 of the holder 6. Further, as shown in the embodiment of FIG. 20(*a*), recessed parts 64 and 65 may be also formed in the shape of a hook so that they surround the corners of a convex portion 67 and convex portions 18' and 19' may be also formed in the shape of a hook as shown in FIG. 20(*b*).

Figure 21A:
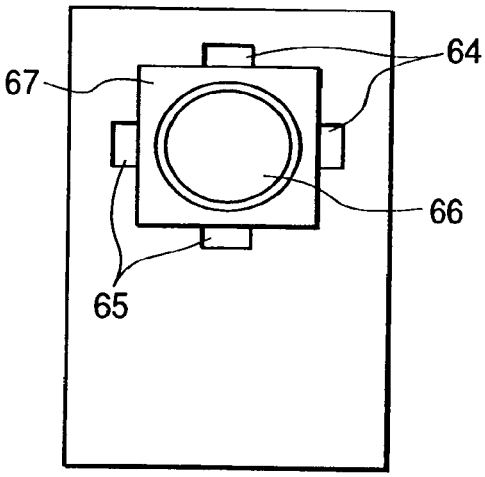
Figure 21B:
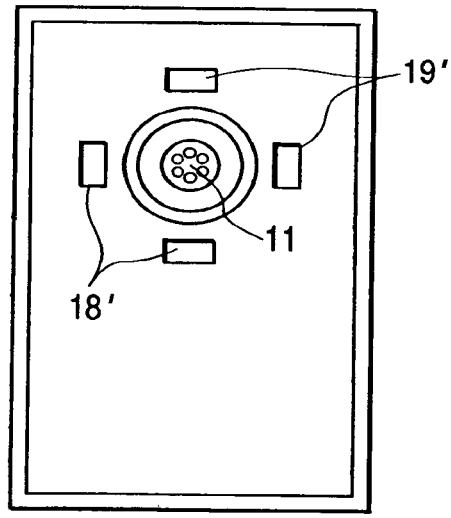

Further, as shown in FIG. 21(*a*), recessed parts may also be formed on a center line passing an ink supply port 66 so that they surround the four sides of a convex portion 67 and corresponding to these, convex portions 18' and 19' may be also arranged on a center line passing the ink supply needle 11 in the cartridge housing chamber 8.

Three colors of ink of at least cyan, magenta and yellow, or four colors of ink if including black, are normally used for color printing. However, to improve the printing quality, cyan and magenta may be classified into two systems of a dark type and a light type. Therefore, a color ink cartridge may be divided into five ink housing chambers and each chamber may be filled with ink of cyan, magenta and yellow which belong to the dark type and ink of cyan and magenta which belong to the light type.

Figure 22A:
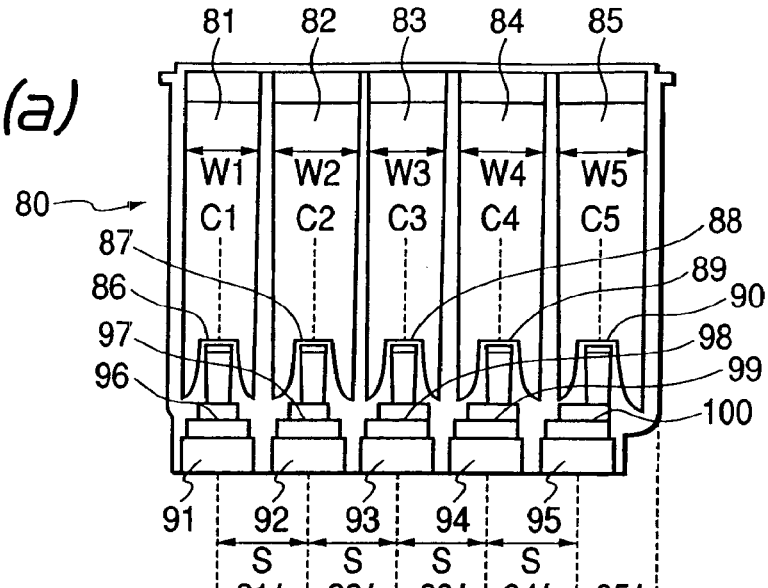
FIGS. 22(*a*) to 22(*c*) are side sectional view showing other embodiments of the ink cartridge constructed in accordance with the invention.
Figure 22B:
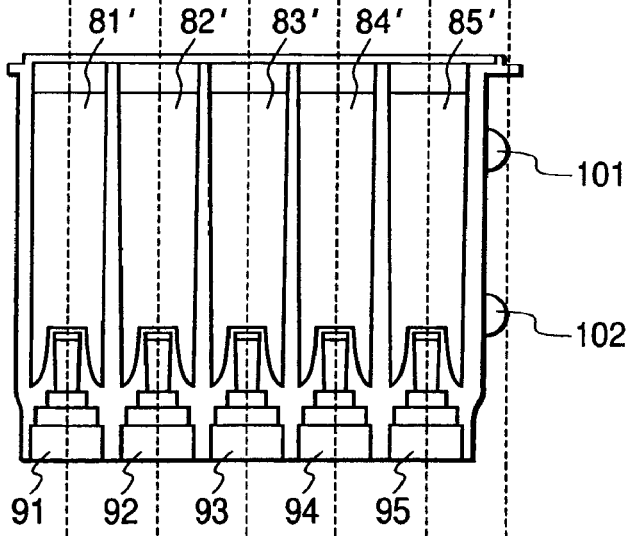
Figure 22C:
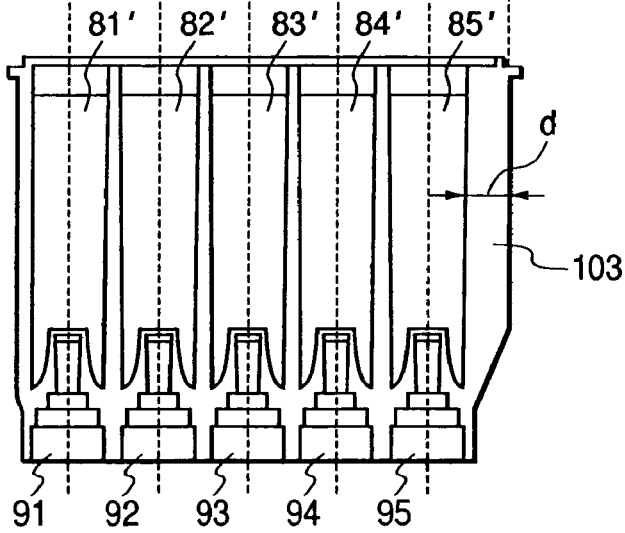

A cartridge 80 for applying the different types of ink is now described in FIGS. 22(*a*)-22(*c*). Ink cartridge 80 includes ink housing chambers 81-85. A respective ink supply port 86-90 is provided in a respective ink housing chamber 81-85. As ink of each color is consumed differently in color printing, the volume of each ink housing chambers 81 to 85 of a cartridge 80 shown in FIG. 22*a* are not equal. More specifically, the width w1 to w5 of each housing chamber is designed to be different from one another to fix the ink consumption rate of the whole ink cartridge. In the meantime, each print head to which ink is supplied from each chamber is arranged at fixed pitch in consideration of control and others in printing and therefore, the arrangement pitch of ink supply needles integrated with each print head is also fixed.

Therefore, if ink supply ports 86 to 90, respectively communicating with the ink housing chambers 81 to 85 of the ink cartridge 80, are formed on the center line c1 to c5 of each chamber, there arises a problem that mis-position is caused between each ink supply needle and each ink supply port of the cartridge, the ink cartridge cannot be installed and the ink supply needle is broken.

FIG. 22*a* shows an embodiment of an ink cartridge to solve these problems and although ink output ports 86 to 90 of ink housing chambers 81 to 85 are arranged on each center line c1 to c5 of the ink housing chambers 81 to 85, ink supply ports 91 to 95 are arranged according to the arrangement pitch S of ink supply needles, and the ink output ports and the ink supply ports are respectively connected via passages 96 to 100 in the shape of a crank. According to this embodiment, the ink consumption rate of each ink housing chamber of the cartridge can be adjusted so that it is approximately equal and in addition, fitting to or detaching from the ink supply needle can be smoothly executed.

In the above embodiment, an ink consumption rate in the ink cartridge 80 is approximately equalized, however, if an ink consumption rate may be uneven, ink supply ports 91 to 95 are arranged according to the arrangement pitch S of ink supply needles and ink housing chambers 81' to 85' are formed so that each center is located on each center line of the ink supply ports 91 to 95, while a gap made between the cartridge and the cartridge holder 6 may also be adjusted by projections 101 and 102 provided on the side (FIG. 22(*b*)) and may also be adjusted by adjusting the thickness d of at least one side wall 103 of the ink cartridge (FIG. 22(*c*)).

If each ink housing chamber 81 to 85 is narrow as described above, the discharge of ink from a porous body impregnated with ink and housed in each ink housing chamber 81 to 85 to each ink supply port 91 to 95 is difficult, compared with an ink cartridge provided with wide ink housing chambers.

Figure 23A:
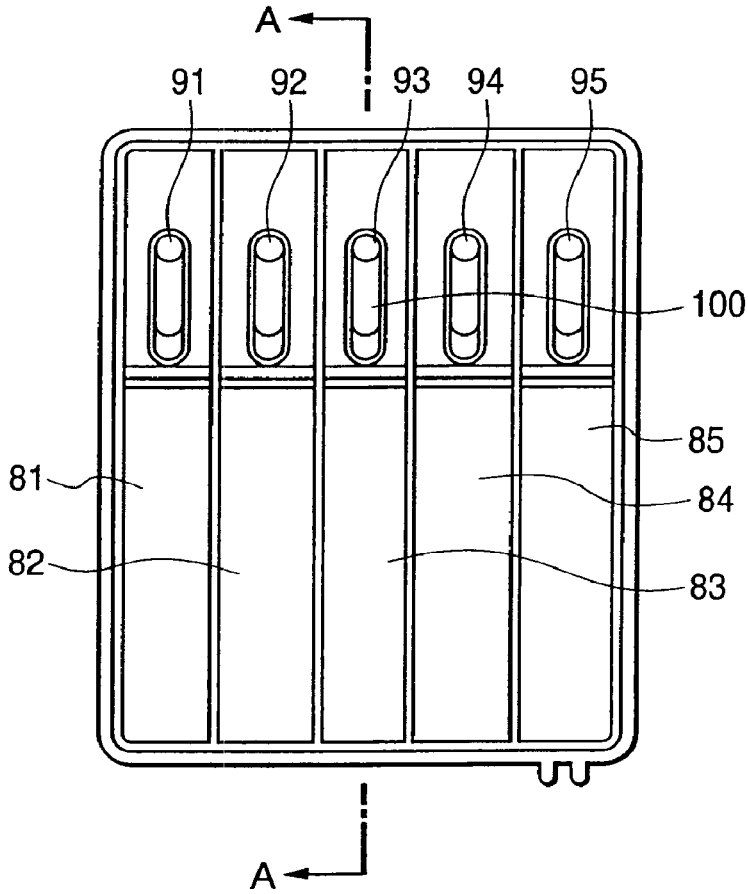
FIGS. 23(*a*) and 23(*b*) are respectively a top plan view showing a state in which a lid is detached in the other embodiment of the ink cartridge and a side sectional view viewed along a line A-A of FIG. 23(*a*)
Figure 23B:
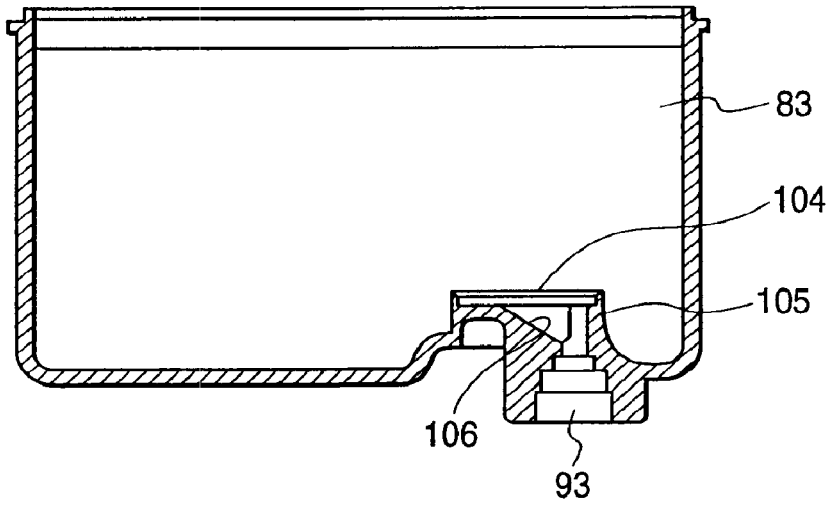

Reference is now made to FIGS. 23(*a*), 23(*b*) in which an embodiment of the invention to solve the above problems is provided. An ink cartridge 280 includes a plurality of ink housing chambers 81-85. A respective ink supply port 91-95 is provided in each housing chamber 81-85. It is desirable that a slant part 106 wider on the side of the ink housing chamber from the side of the ink supply port 93 is formed in a protruding part 105 which protrudes toward the ink housing chamber 83. A filter 104 is affixed to projection 104 as shown in FIG. 23(*b*). The slant part 106 may be arcuated if desired, so that air bubbles may be guided more effectively to the ink supply port 93.

Figure 24A:
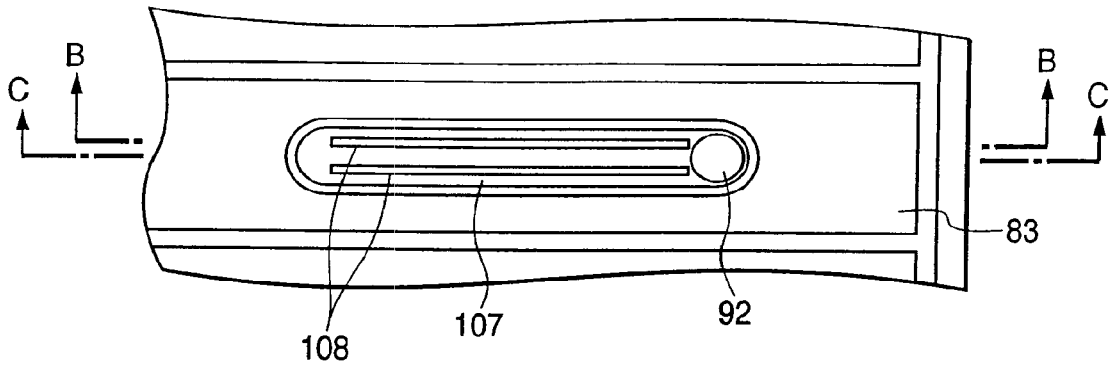
FIGS. 24(*a*) to 24(*c*) are respectively an enlarged top plan view showing the area of a cartridge in the vicinity of an ink supply port in accordance with the other embodiment of the ink cartridge and sectional views viewed along lines B-B of FIG. 24(*b*) and C-C of FIG. 24(*c*)
Figure 24B:
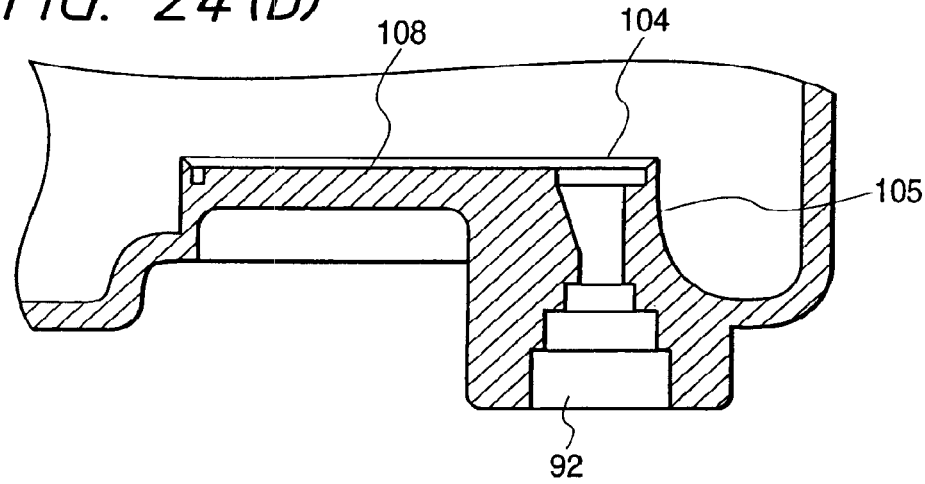
Figure 24C:
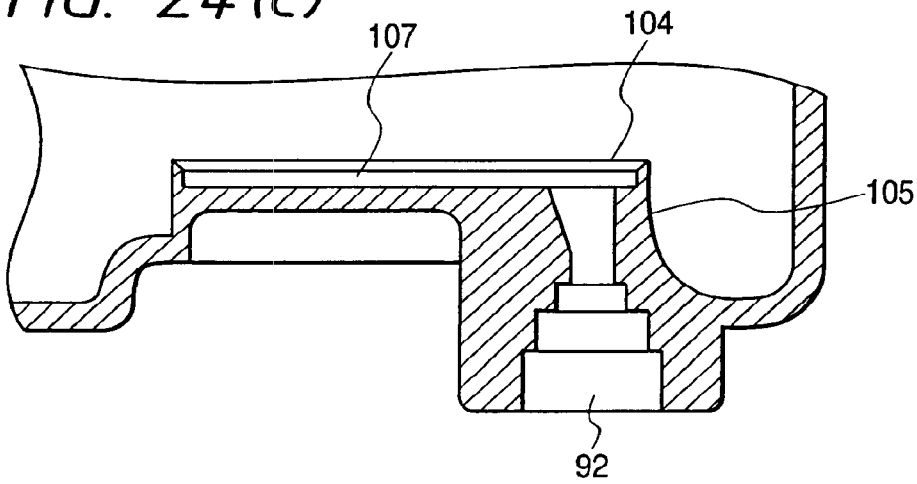

Further, when an elongated convex portion 108 is formed on a recessed part 107 formed between the protruding part 105 and the filter 104 as shown in FIGS. 24(*a*)-(*c*), where protruding part 105 is relatively narrow as shown in FIG. 23(*b*), the filter 104 can be prevented from being bent by the pressure of a porous body housed in the ink housing chamber 83 and ink can be made to flow smoothly to the ink supply port 92 by the capillary force of a fine groove generated by the convex portion 108.

Figure 25A:
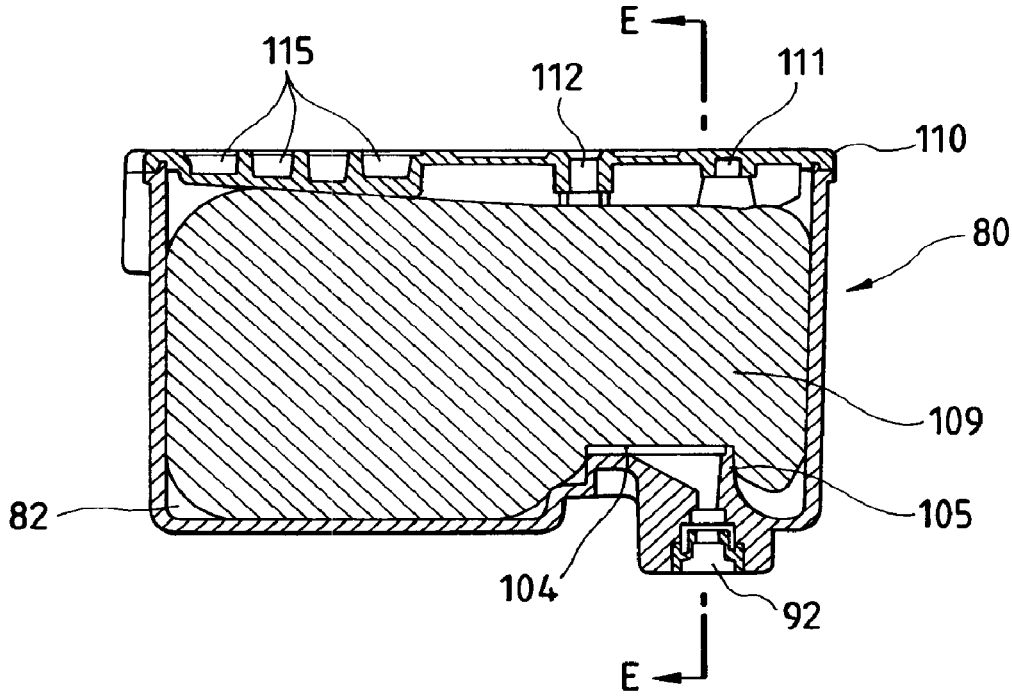
FIG. 25(*a*) is a side sectional view of an ink cartridge showing a state in which one ink housing chamber of the above ink cartridge is filled with ink, and FIG. 25(*b*) is a front sectional view showing the ink cartridge cut along a line E-E in FIG. 25(*a*)
Figure 25B:
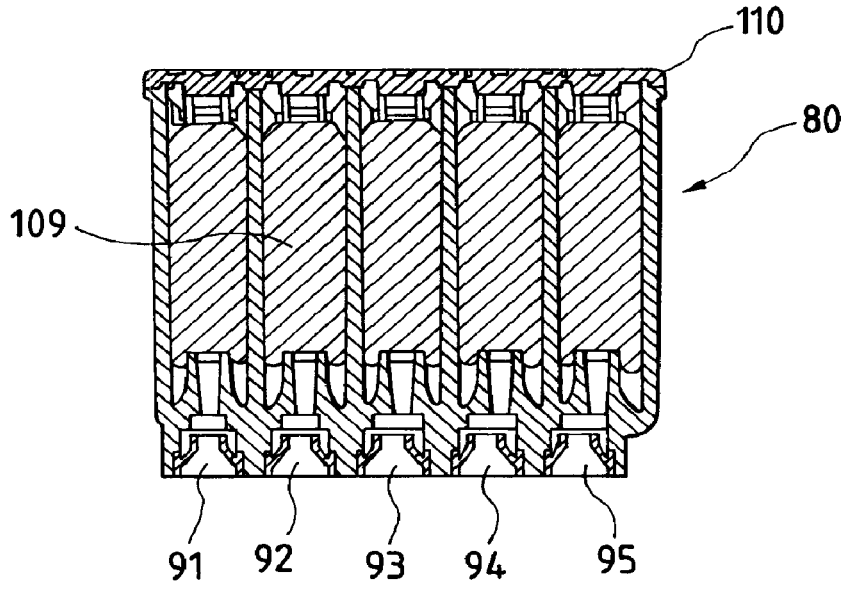

A porous body 109 impregnated with ink as shown in FIG. 25(*a*) is originally disposed in each ink housing chamber 81 to 85 (the ink housing chamber 82 is represented in FIG. 25(*a*) of such an ink cartridge so that the porous body is touched to the filter 104 as shown in FIG. 25(*b*) and is sealed by a lid 110.

In the ink cartridge 80 in which multiple ink housing chambers 81-85 are formed as described above, it is difficult to form a fine, circuitous groove to function as a capillary having large fluid resistance on the lid 110. That is, to increase fluid resistance, the cross section of the fine groove has only to be reduced, however, there is a problem that clogging is caused by dust and the like and ink is not supplied in printing. Therefore, as the cross section to some extent is required, fluid resistance is required to be secured by the length of the fine groove.

Figure 26:
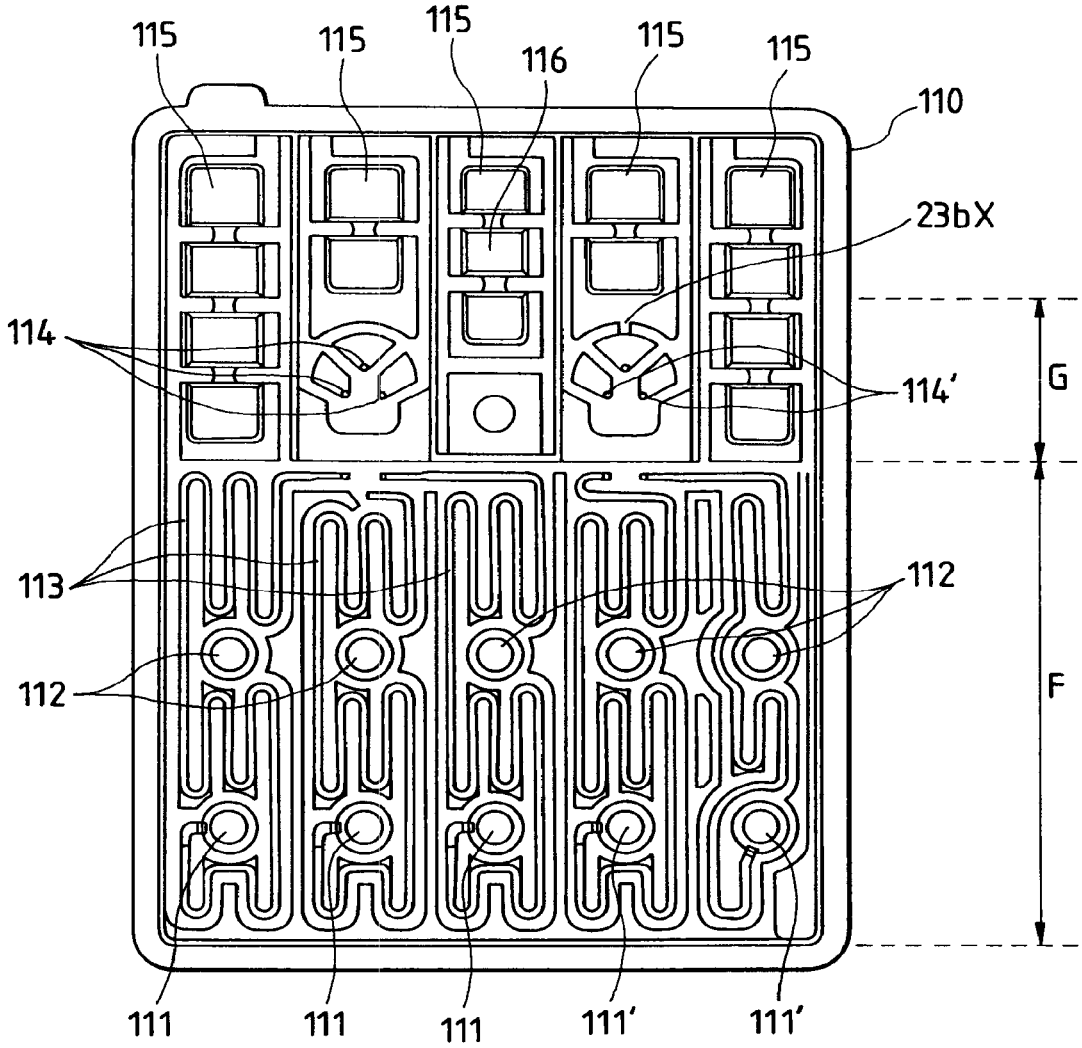
FIG. 26 is a top plan view showing the structure of a lid suitable for the ink cartridge shown in FIGS. 25(*a*) and 25(*b*) in a state in which a film is peeled.
Figure 27:
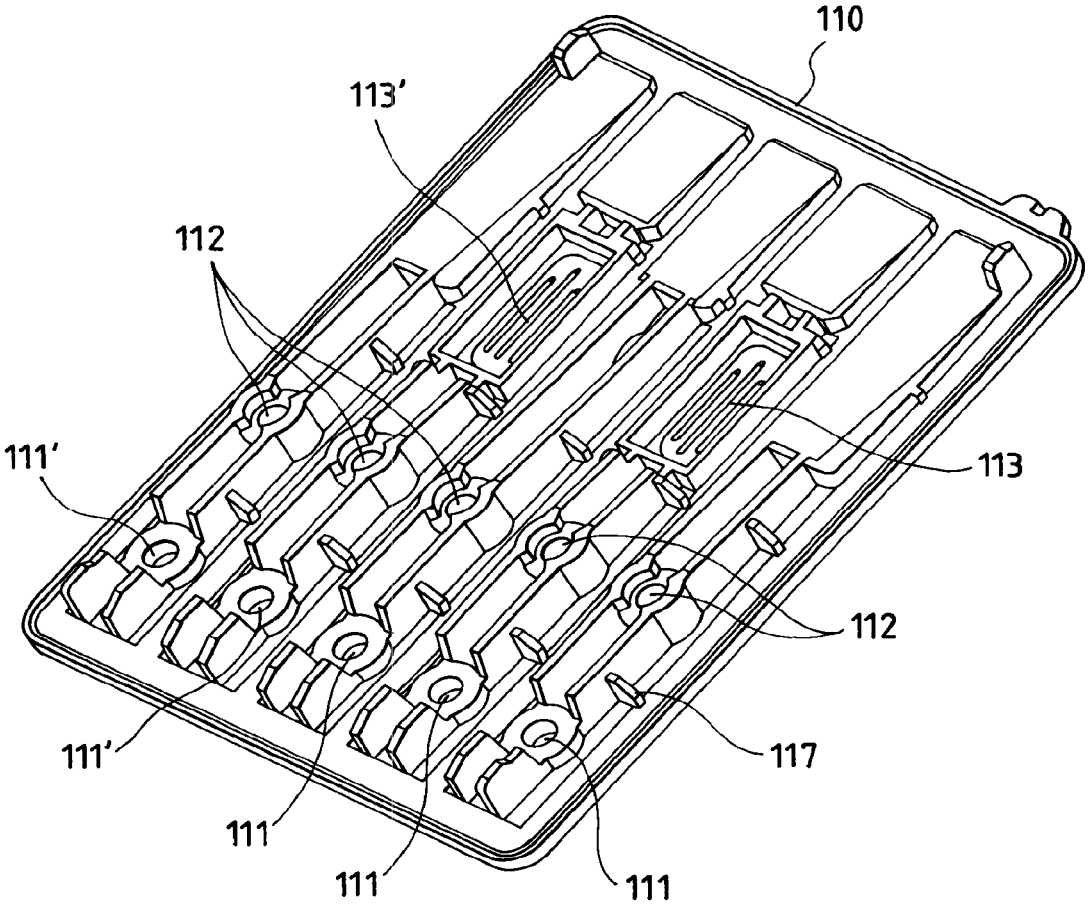
FIG. 27 is a perspective view showing a rear side of the lid shown in FIG. 26.

FIGS. 26 and 27 are views showing an embodiment of a cartridge lid 110 designed in view of the foregoing problems. Lid 110 includes air communicating ports 111 and 111' ink inlets 112 and fine grooves 113. A respective end of fine grooves 113 communicates with each air communicating port 111, 111' which are formed so that they communicate with each ink housing chamber 81-85. As shown in FIG. 27, vertical ribs 117 are formed in the inner face of the lid 110. The both the ends of the vertical ribs 117 perform to guide the cartridge lid 110 into the cartridge body when the lid 110 is coupled to the cartridge body. Because an upper-outer corner of the vertical rib 117 is chamfered to have an angled surface, the lid 110 can smoothly be coupled to the cartridge body while guided by the angled surface of the rib 117.

The fine groove 113 is formed in an area opposite to each ink housing chamber where no air communicating port 111 or 111' and no ink inlet 112 in the above capillary forming area exist so that the fine groove meanders plural times and the fine grooves respectively communicate with openings 114 and 114' for communicating with the air via communicating areas 113 and 113' having the similar structure to the communicating passages 74 shown in FIG. 12.

As clear from the above description, lid 110 may be divided into an area F in which the fine grooves 113 and 113' are formed is sealed by a film which cannot be peeled off by a user and an area G of the openings 114 and 114' for communicating with the air is sealed by a film which can be peeled by a user. Plural recessed parts 115 for securing volume are formed on the side on which the openings for communicating with the air 114 and 114' are formed and if necessary, a recessed part 116 for fitting to the projection 5*a* shown in FIG. 9 of the lever 5 is also formed.

Figure 28A:
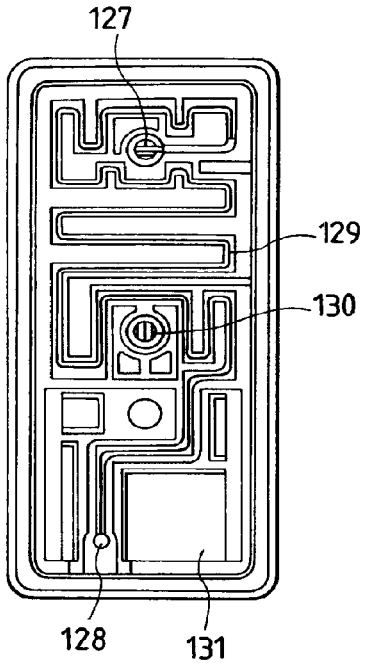
FIGS. 28(*a*) to 28(*d*) respectively show the structure of the upper surface of the ink cartridge, sectional structure viewed along lines D-D and E-E and the structure of the rear of the lid.
Figure 28B:
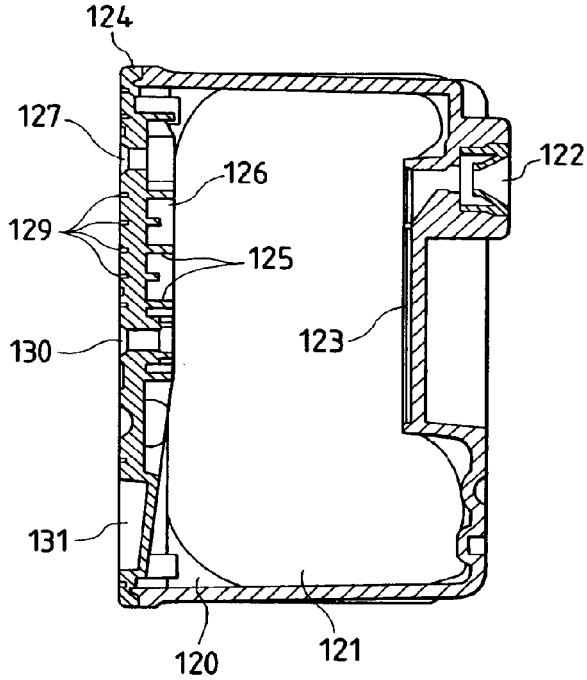
Figure 28C:
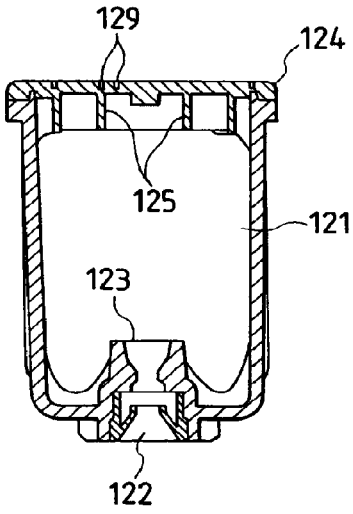
Figure 28D:
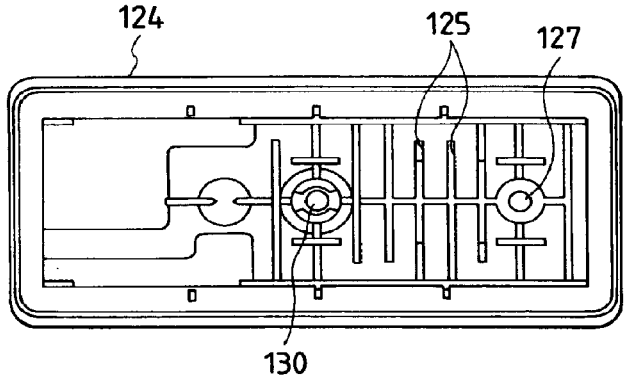

If the lid 124 is formed by injection molding, a so-called shrink is easily caused in an area where the fine groove 113 is formed. In the meantime, as for the ink cartridge, a porous body 121 impregnated with ink is housed in an ink housing chamber 120 as shown in FIG. 28*b* so that the porous body 121 is touched to a filter 123 of an ink supply port 122. In this case, slight space 126 is secured by a rib 125 on the rear of a cap 124 to prevent ink from leaking due to the rapid change of temperature.

Therefore, it is desirable that the above rib 125 is formed so that the rib is opposite to a fine groove 129 connecting an air communicating port 127 and an opening open to the air 128 respectively of the lid 124. A reference number 131 denotes a recessed part for fitting to the projection 5*a* shown in FIG. 9 of the lever 5.

Figure 29:
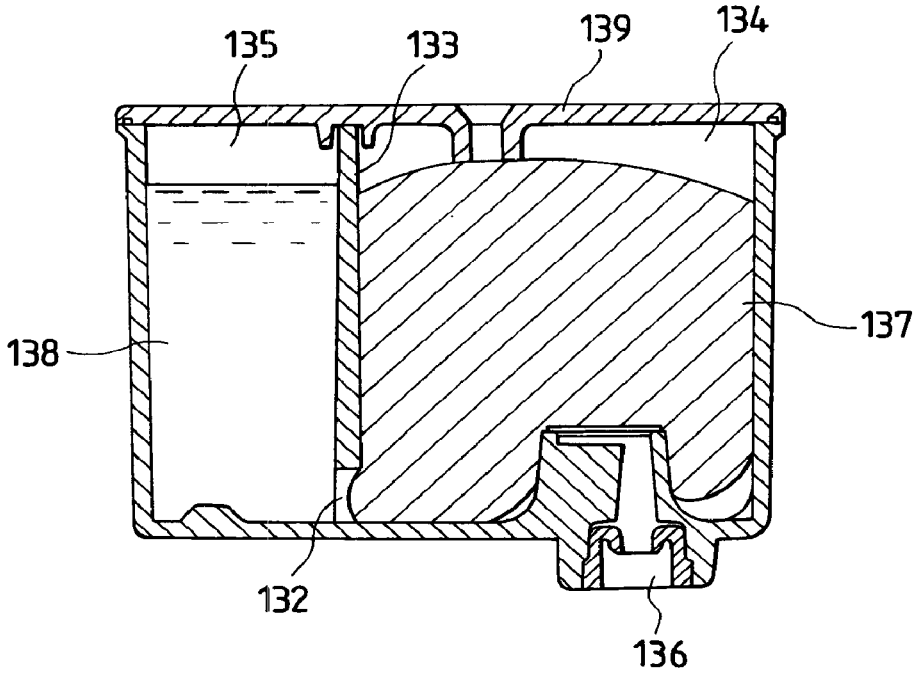
FIG. 29 is a sectional view showing the structure of another type of ink cartridge to which the present invention can be applied.

In the above embodiments, a porous body impregnated with ink is housed in the whole ink housing chamber, however, even if the present invention is applied to an ink cartridge wherein one ink housing chamber is divided into two chambers 134 and 135 by a partition 133 at the bottom of which a communicating port 132 is provided as shown in FIG. 29, a porous body 137 impregnated with ink is housed on the side of an ink supply port 136 and ink 138 is housed in the other chamber 135, a similar action is produced.

Figure 30:
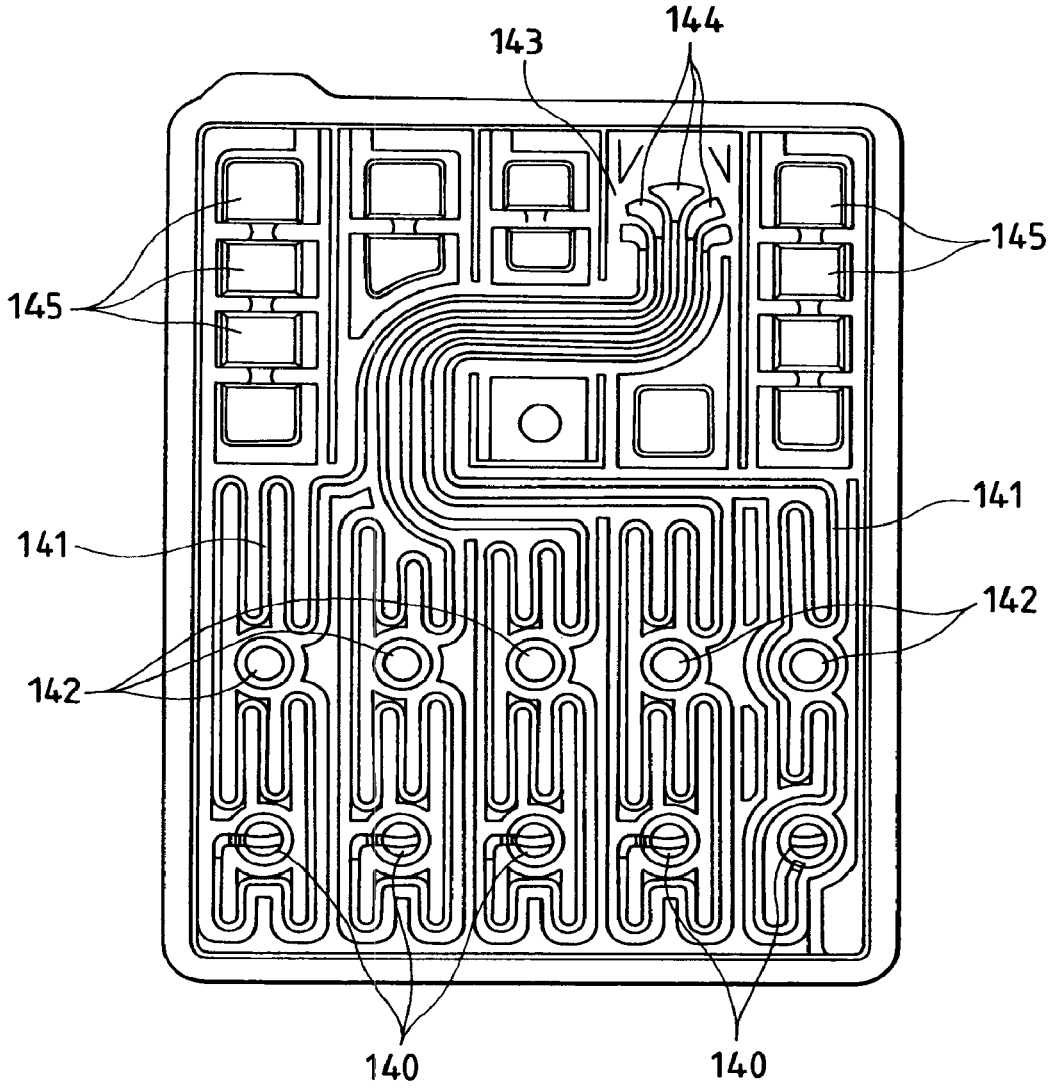
FIG. 30 shows another embodiment of fine grooves formed on a lid in accordance with the invention.

Also, in the above embodiments, the fine, circuitous groove creating a capillary action connects to the opening for communicating with the air via the tunnel-like communicating passage formed on the lid however, even if fine grooves 141 respectively connected to air communicating ports 140 of plural ink housing chambers are made to meander so that the fine groove is opposite to the above ink chamber in a central area in which the air communicating ports 140 and ink inlets 142 are formed, are collected with each independent on the side of the other end and are respectively connected to openings for communicating with the air 144 sealed by a film which can be peeled in a very narrow area 143, recessed parts 145 for securing decompression space can be formed in relatively large size as shown in FIG. 30.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A liquid container configured to be mounted on an apparatus provided with a needle member and a projection, the liquid container comprising:

a first face;

a second face different from the first face, wherein the second face faces the opposite direction from that which the first face faces;

a liquid containing chamber containing a liquid therein;

a liquid supply port provided on the first face and configured to receive the needle member to supply the liquid to the apparatus therethrough when the liquid container is mounted on the apparatus;

an atmosphere opening port configured to introduce external air into the liquid containing chamber therethrough as the liquid is consumed;

a recess provided on the second face; and a sealing film covering the recess and the atmosphere opening port, the sealing film being removable from the liquid container, wherein the recess is configured to receive the projection under a condition that the sealing film is removed from the liquid container.

2. The liquid container as set forth in claim 1, wherein the sealing film is configured to block the projection a condition that the sealing film is not removed from the liquid container.

* * * * *